US008306236B2

(12) United States Patent
Asada et al.

(10) Patent No.: US 8,306,236 B2
(45) Date of Patent: Nov. 6, 2012

(54) SOUND FIELD MEASURING APPARATUS AND SOUND FIELD MEASURING METHOD

(75) Inventors: Kohei Asada, Kanagawa (JP); Tetsunori Itabashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 1610 days.

(21) Appl. No.: 11/486,333

(22) Filed: Jul. 13, 2006

(65) Prior Publication Data

US 2007/0019815 A1 Jan. 25, 2007

(30) Foreign Application Priority Data

Jul. 20, 2005 (JP) ..... 2005-210431

(51) Int. Cl.
*H04R 29/00* (2006.01)

(52) U.S. Cl. ..... 381/58; 381/59; 381/310; 381/26

(58) Field of Classification Search ..... 381/56–59, 381/62–64, 7, 17, 18, 19, 22, 310, 98, 101, 381/103, 95, 96, 122, 26; 386/96, 125
See application file for complete search history.

(56) References Cited

U.S. PATENT DOCUMENTS 4,273,956 A * 6/1981 Wolfe ..... 379/167.05
2002/0181721 A1* 12/2002 Sugiyama et al. ..... 381/92
2004/0151476 A1* 8/2004 Suzuki ..... 386/96
2004/0240676 A1* 12/2004 Hashimoto et al. ..... 381/56
2005/0053249 A1* 3/2005 Wu et al. ..... 381/310

FOREIGN PATENT DOCUMENTS

| | | | |
|---|---|---|---|
| EP | 1718114 | A1 * | 11/2006 |
| JP | 01-251900 | A | 10/1989 |
| JP | 06-121396 | A | 4/1994 |
| JP | 2000-261900 | | 9/2000 |
| JP | 2001-352600 | A | 12/2001 |
| JP | 2004-241820 | A | 8/2004 |
| JP | 2005-236502 | A | 9/2005 |
| JP | 2005-341534 | | 12/2005 |

* cited by examiner

*Primary Examiner* — Vivian Chin
*Assistant Examiner* — Leshui Zhang
(74) *Attorney, Agent, or Firm* — Wolf, Greenfield & Sacks, P.C.

(57) ABSTRACT

A sound field measuring apparatus includes a microphone set having a first and second microphones arranged at a prescribed interval, which collects audio signals outputted from a first and second speakers, a measuring unit measuring distances between the first and second speakers, and the first and second microphones based on audio signals collected by the first and second microphones, and a position calculating unit calculating a position of the first and second microphones and a position of the second speaker when the first speaker is taken as a reference position based on the respective measured distances.

14 Claims, 17 Drawing Sheets

SOUND FIELD MEASURING APPARATUS AND SOUND FIELD MEASURING METHOD

CROSS REFERENCES TO RELATED APPLICATIONS

The present invention contains subject matter related to Japanese Patent Application JP 2005-210431 filed in the Japanese Patent Office on Jul. 20, 2005, the entire contents of which being incorporated herein by reference.

BACKGROUND OF THE INVENTION

1. Field of the Invention

The invention relates to a sound field measuring apparatus and a sound field measuring method capable of calculating positional relationship of speakers in real space as output means for forming, for example, a multichannel audio system.

2. Description of the Related Art

In playback systems of video data, musical data and the like, it is relatively easy for users to evaluate realistic sensation or sound quality as good or not good. For example, when a user listen to an orchestral piece, it is preferable that a sound field can be generated, in which the user can sense positions of respective instruments clearly and can recall an image as if a real orchestra performs right before the user in a virtual sound field.

For example, there are a two-channel stereo system which adjusting sound volume of respective signal channels of two channel stereo signal including a L-signal and an R-signal, so that a sound image of a playback sound field is located in an optimum position as a virtual sound image, and outputs signals from two speakers, a three-channel stereo system in which a center speaker is added in the middle of right-and-left two channel speakers, 5.1 channel stereo system in which further rear speakers are added, and the like.

For example, in a multichannel audio system such as the 5.1 channel stereo system, parameters of audio signals outputted from respective speakers are decided so as to reproduce a realistic sound field. For example, the balance of sound volume and sound quality of playback audio at the position where the listener listens vary depending on a so-called listening environment including a structure of a listening room, a user's position with respect to speakers and the like, therefore, there was a problem that the sound field (acousmato) which is actually felt by the listener may be different from the ideal playback sound field created at the time of recording.

The above problem is prominent in a small space such as a small room and in a car. In the interior of the car, the listener's position is limited to the position of a seat in many cases, a distance interval between speakers and the listening position is large. Therefore, time differences of reaching time of audio signals outputted from speakers occur and the balance of the sound field is lost significantly. Particularly, the car interior is in an almost sealed condition, reflection sound and the like are intricately synthesized and reaches the listener, which becomes a factor of confusing the playback sound field in the listening position. Further, in the small room or in the car, positions of installing speakers are limited, when it is difficult to realize speaker positions where output sound from speakers directly reaches ears of the listener, changes of sound quality due to the speaker positions affect deterioration of the playback sound field.

Accordingly, in order to create the playback sound field closed to the original sound field as much as possible according to the listening environment in which the listener actually uses the audio system, appropriate acoustic correction is performed to output audio signals. First, audio characteristics in the listening environment are measured, then, parameters of signal processing to which the acoustic correction is performed are set to an audio output system of the audio set based on the measured result. The audio signals processed according to the set parameters are outputted from speakers, thereby reproducing a good sound field which has been corrected so as to fit into the listening environment. As the acoustic correction, for example, delay time to be given to the audio signals may be corrected according to reaching time from the speakers to the listening position, so that the audio signals of respective channels outputted from speakers reach the listening position of the listener (position of ears) almost at the same time.

As an example of measurement of acoustic characteristics and acoustic correction based on the measurement, the following method using an acoustic correction apparatus disclosed in Patent document 1 is known.

First, a microphone for measurement is arranged at a position of the listener's ears (listening point) in a space in which the audio set is used, namely, in the listening space. Then, a measuring tone is outputted from the speaker, and the measuring tone is collected by the microphone, and distance information between each speaker and the listening position (setting position of the microphone, namely, position of collecting sound) is calculated from characteristics of the collected audio signal. Since reaching time of audio in a space from respective speakers to the listening position can be obtained based on the distance information, the acoustic correction apparatus can set delay time of the audio signal of a the channel corresponding to each speaker by using information of reaching time of respective speakers, so that timings at which audio emitted from respective speakers reach the listening position coincide. Accordingly, to correct reaching time and phase displacement of audio signals until the listening point is called as a time alignment adjustment.

Patent document 1: JP-A-2000-261900

SUMMARY OF THE INVENTION

When the above measurement of the sound field is performed, it is possible to select a corrected value of a particular parameter with respect to a local state of frequency of the playback audio signal in the listening environment (peak or dip) or variation of frequency characteristics by using one microphone, and when the equivalent measurement is performed by using plural microphones, and the calculated values are averaged or the like, it is obvious to realize more flexible treatment.

In the method of adjusting the time alignment, an actual playback sound field in the listening environment is measured at plural points in the listening environment by using plural microphones. However, in the case that measurement is performed at plural points in the listening environment, the measurement will be large in scale when the number of microphones increases, and the adjustment operation of time alignment is complicated and troublesome for the listener for the reason that the listener has to select where a standard of the time alignment should be and the like.

For the above reason, there is a demand for measuring the playback sound field in the listening environment by fewer numbers of microphones, however, when two microphones are used, for example, the speaker position with respect to the collecting point is not fixed when only the distances between the speaker and the microphones are known.

All points which are equivalent distance from two collection points correspond to candidates for the speaker position with respect to the collecting points. That is, all points on an outer circumference of a base of a cone whose apex is the collecting point can be candidates for the speaker position. Therefore, even when limited to a two-dimensional plane including the speaker and two collecting points, two corresponding points are always calculated. Since the positional relationship between the both cannot be distinguished on computed values, it was difficult to specify the speaker position accurately.

The invention has been provided in view of the above conventional conditions, and it is desirable to provide a sound field measuring apparatus and a sound field measuring method capable of specify a speaker position which cannot usually be specified by two microphones.

According to an embodiment of the invention, there is provided an apparatus, in a sound field measuring apparatus for measuring arrangement positions of a first and second speakers arranged in a playback environment, including a microphone set having a first and second microphones arranged at a prescribed interval, which collects audio signals outputted from the first and second speakers, a measuring unit measuring distances between the first and second speakers, and the first and second microphones based on audio signals collected by the first and second microphones, and a position calculating unit calculating a position of the first and second microphones and a position of the second speaker when the first speaker is taken as an original point (standard position) based on the respective measured distances, thereby calculating positions of the first and the second speakers arranged in the playback environment.

The position calculating unit calculates a position of the first speaker as being positioned in a positive direction area with respect to the microphone set, based on a distance between the microphone and the speaker measured at the measuring unit with respect to the first speaker, and calculates candidates for a position of the second speaker with respect to the microphone set, taking the first speaker as the standard position.

The position calculating unit also compares candidates for the position of the second speaker calculated from audio signals outputted from the second speaker and collected by the microphone set installed at a first arrangement with candidates for the position of the second speaker calculated from audio signals outputted from the second speaker and collected by the microphone set installed at a second arrangement to specify the position of the second speaker.

It is important that the second arrangement and the first arrangement are not on a line connecting the first and second microphones, and the first arrangement and the second arrangement may be the arrangement in which a distance between the first speaker and the first microphone, and a distance between the first speaker and the second microphone are almost equivalent.

DETAILED DESCRIPTION OF THE PREFERRED EMBODIMENTS

Hereinafter, a sound field measuring apparatus shown as an embodiment of the invention will be explained in detail with reference to the drawings. The sound field measuring apparatus shown as the embodiment is mounted on an audio set supporting a so-called multichannel system in which plural speakers are connected and a sound field at the time of recording can be realistically reproduced by audio signals outputted from respective speakers, which can accurately measure positional information of respective speakers necessary for analyzing sound field parameters which are given to original audio signals for generating a more realistic sound field.

Figure 1:
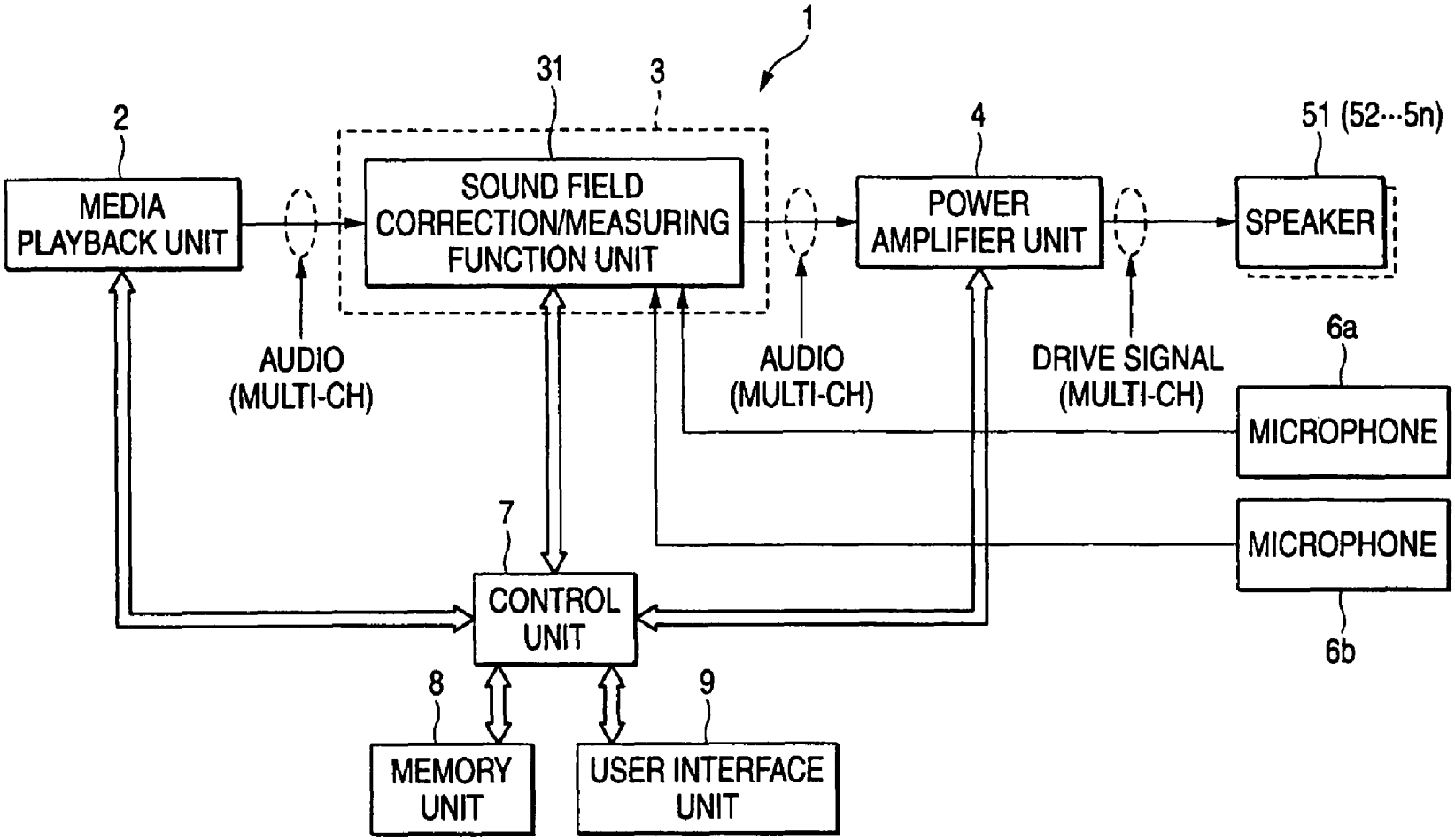
FIG. 1 is a structural diagram for explaining an audio set to which a sound field measuring apparatus according to an embodiment of the invention is applied.

FIG. 1 shows a structural example of the whole audio set to which the sound field measuring apparatus according to an embodiment of the invention is applied.

An audio set 1 shown in FIG. 1 includes a media playback unit 2 reading data of musical contents recorded in recording media (hereinafter, referred to as media), a sound-field correction unit 3 having a sound field correction function of changing characteristics of reproduced original multichannel audio signals and a function of measuring signals collected by microphones 6*a*,6*b* and a power amplifier unit 4 multiplying respective corrected multichannel audio signals and supplying them to respective types of speakers 51 to "5*n*", and further includes two microphones 6*a*, 6*b* measuring a sound field generated by audio signals outputted from respective speakers. In addition, the audio set 1 includes a memory unit 8 which stores programs for executing a process of correcting the sound field in the sound field correction unit 3, and a process of measuring output signals from the speakers by the collected signals of the microphones 6*a*, 6*b*, or information necessary for the processes. As the memory unit 8, nonvolatile and rewritable memory elements, for example, a flash memory and the like can be applied. The above respective units are totally controlled by a control unit 7.

The media playback unit 2 reads data of audio contents recorded in the media. A type, a recording format and the like of media which can be reproduced in the media playback unit 2 are not especially limited but, for example, CD (compact Disc) and DVD (Digital Versatile Disc) can be cited as examples.

In the present DVD format, audio data is compressed and encoded in accordance with systems such as DVD Audio, AC3 (Audio Code Number 3) which are compliant with a DVD standard. Therefore, the media playback unit 2 also includes a decoder for decoding the compressed and encoded audio data.

The media playback unit 2 can be a so-called compo drive whereby both DVD and audio CD can be reproduced. An input destination of audio signals is not limited to media which can be reproduced in the media playback unit 2 but can be a television tuner which receives and demodulates television broadcasting and the like and outputting video signals and audio signals. The input destination can be also a server apparatus which supplies audio signals through wired LAN, wireless LAN, networks, or a large-scale network formed by connecting the above networks such as so-called Internet. Further, high-capacity recording media such as a hard disk can be also preferable. Additionally, it is also preferable that the media playback unit 2 includes the above configuration for media playback, the television tuner, the configuration for connecting to the network, HDD and the like by combining them.

The media playback unit 2 corresponds to multi audio channels, audio signals read by the media playback unit 2 are outputted from plural kinds of signal lines corresponding to respective audio channels. In the embodiment, the audio set 1 supports a 5.1 channel surround system, and the media playback unit 2 outputs audio signals of 6 kinds of audio signals to speakers corresponding to a center channel (C), a front left channel (FL), a front right channel (FR), a left surround channel (BL), a right surround channel (BR) and a sub-woofer channel (SW) at the maximum. The audio signals reproduced in the media playback unit 2 are inputted to the power amplifier 4 as signals whose acoustic characteristics are corrected in the measuring function unit and the sound field correction function unit of the sound field correction unit 3. The details of the sound field correction unit 3 will be described later.

The power amplifier unit 4 outputs drive signals for driving speakers by amplifying inputted audio signals. In the case, the power amplifier unit 4 includes circuit systems corresponding to the number of channel configurations supported by the audio set 1, amplifies the audio signals by respective amplification circuits with respect to respective channels, and outputs drive signals to speakers corresponding to the center channel (C), the front left channel (FL), the front right channel (FR), the left surround channel (BL), the right surround channel (BR) and the sub-woofer channel (SW) which are arranged at appropriate positions, for example, in the listening environment described above. According to the multichannel configuration, the audio set 1 can reproduce a recording environment when a musical content was recorded to the present listening environment.

As for the speakers 51 to 5*n*, the number of speakers corresponding to the number of channels can be connected. In the embodiment, six speakers in total are connected to respective channels because of the 5.1 surround system. When the audio set 1 supports a 7.1 channel surround system, eight speakers corresponding to respective channels can be connected. The arrangement of speakers and microphones in the audio set 1 will be explained with reference to FIG. 2.

Figure 2:
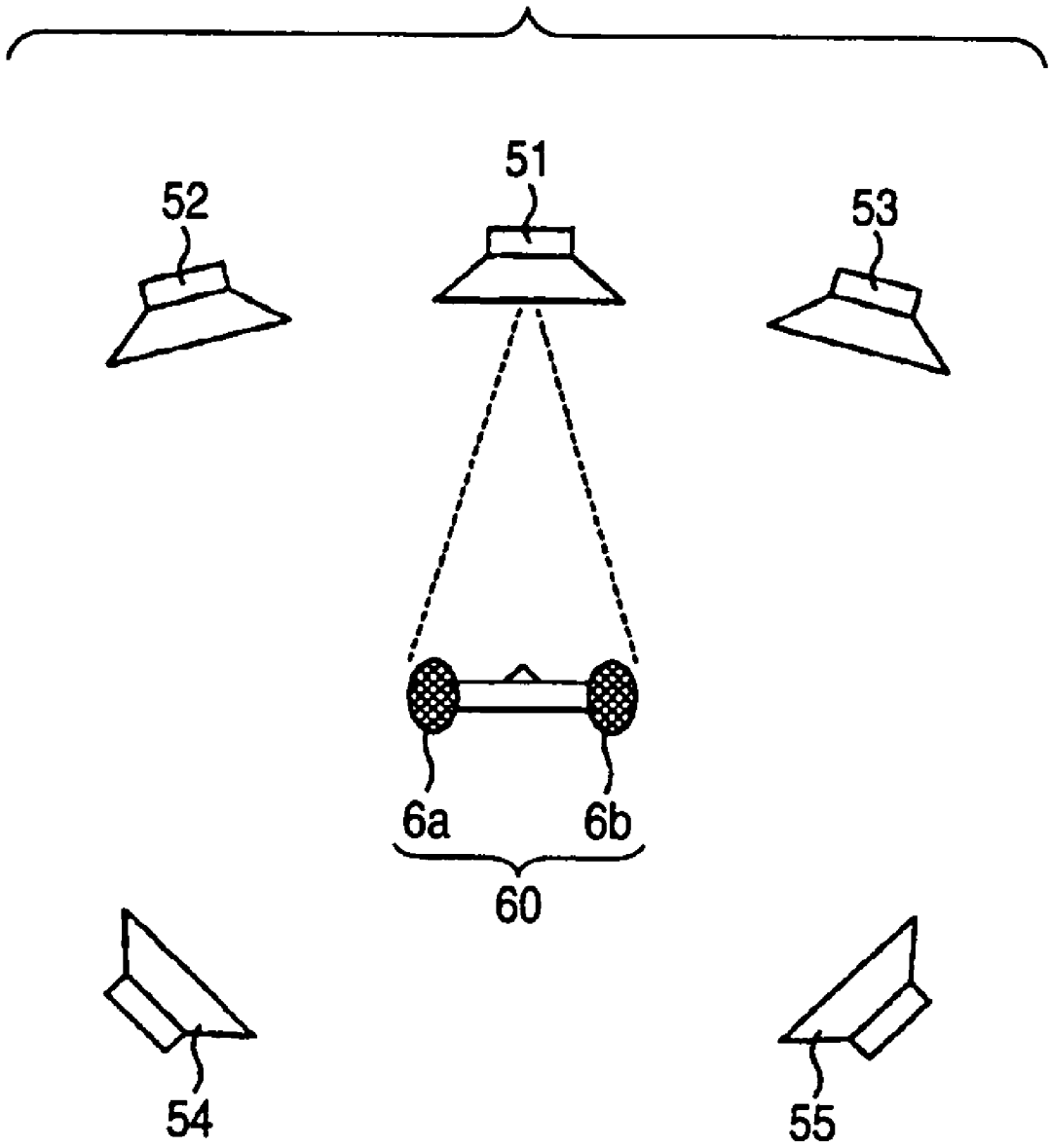
FIG. 2 is a schematic view for explaining the arrangement of speakers and microphones in the audio set.

FIG. 2 shows a typical speaker arrangement in the audio set which supports the 5.1 channel surround system. In the embodiment, for convenience of explanation, the sound producing center of speakers and the sound collecting center of microphones are supposed to be set in the same height (in the same plane), and a method of specifying arrangement positions in a two-dimensional plane is explained, however, it is possible to specify speaker positions by the same method also in a three-dimensional space, which is included in the present invention. In the case of applying the invention to the three-dimensional space will be explained in a later paragraph.

The speaker 51 shown in FIG. 2 corresponds to the center channel (C), the speaker 52 corresponding to the front left channel (FL), the speaker 53 corresponding to the front right channel (FR), the speaker 54 corresponds to the left surround channel (BL) and the speaker 55 corresponds to the right surround channel (BR) respectively. The audio set 1 also includes the speaker for the sub-woofer channel (SW) not shown in FIG. 2, and the media playback unit 2 outputs six kinds of audio signals corresponding to these six channels.

According to the audio signals outputted from speakers arranged as FIG. 2, a sound field is generated in an area surrounded by speakers. As the listening environment where the audio set 1 is used, for example, the interior of a car, the interior of a small room and the like can be cited.

The microphones 6*a*, 6*b* are means for collecting a prescribed measuring tone when the sound field generated in the listening environment is measured, and it is preferable that the microphone 6*a* and the microphone 6*b* are, when one speaker in the plural speakers is taken as a standard, set in almost equivalent distances from the standard speaker. In the embodiment, the microphone 6*a* and the microphone 6*b* are fixed with each other at an interval in which the characteristic difference according to their setting positions in the listening environment does not appear, for example, an interval of 20 cm, which form a microphone set 60. The audio signals collected by the microphone 6*a*, 6*b* are inputted to the sound field correction unit 3.

The control unit 7 includes a microcomputer having a CPU (Central Processing Unit), a ROM, a RAM and the like, which performs control and executes various kinds of processing with respect to respective units or various functional parts included in the audio set 1 shown in FIG. 1. It is also preferable that a user interface unit 9 for receiving operational selection by the user is connected to the control unit 7.

Subsequently, an internal configuration of the sound field correction unit 3 will be explained in detail with reference to FIG. 3.

The sound field correction unit 3 includes a sound field correction/measuring function unit 31 having a function of correcting the sound field and a function of measuring output audio from speakers. The sound field correction/measuring function unit 31 includes a sound field correction processing block 32 which corrects characteristics of the original audio signals, and a measuring processing block 33 which measures audio characteristic information necessary for analyzing parameters and the like which are given to the original audio signals for generating a more realistic sound field.

The sound field correction/measuring function unit 31 includes a microphone amplifier 34*a* which amplifies the audio signal inputted from the microphone 6*a* and a microphone amplifier 34*b* amplifies the audio signal inputted from the microphone 6*b*, and signals to be measured amplified in the microphone amplifiers 34*a*, 34*b* are transferred to the measuring processing block 33, where measuring processing is performed.

The sound field correction processing block 32 performs processing for correcting the sound field based on the measuring result to change predetermined parameter values. A switch 35 is provided for switching a measuring mode and a sound field correction mode. In the switch 35, switching is performed such that a terminal Tm2 or a Tm3 is selectively connected to a terminal Tm1. The switching is controlled by the control unit 7.

The measuring processing block 33 further includes measuring units 331*a*, 331*b*, a measuring tone processing unit 332 and a speaker position calculating unit 333. The measuring tone processing unit 332 generates and outputs an audio signal for measurement. Hereinafter, the audio signal for measurement is referred to as a measuring tone signal. The measuring tone signal is a particular signal tone created by the CPU (Central Processing Unit) included in the control unit 7 of the audio set 1 or a not-shown DSP (Digital Signal Processor) and the like. Therefore, the characteristic difference between characteristics of the measuring tone signal simultaneously collected by the microphones 6*a*, 6*b* and the signal characteristics when it was created can be analyzed by the DSP and the CPU. In FIG. 3, for convenience of showing the drawing, a signal output line from the measuring tone processing unit 332 is shown as one line, however, there are actually signal output lines corresponding to the number of channels. It is also preferable that measuring tone signals generated in advance are recorded in the storage media in the memory unit 8 or the measuring tone processing unit 332 and that the measuring tone signals are read out at the time of measurement.

The measuring tone signals outputted from the measuring tone processing unit 332 in the measuring processing block 33 are inputted to the power amplifier 4 through the switch 35 (Tm 2 to Tm1), amplified there and outputted from the speakers 51 to 56. When the measuring tone processing unit 332 outputs audio signals of the measuring tone (phoneme) to plural channels at the same time, the power amplifier unit 4 amplifies each of the individual measuring signal with respect to every channel, and outputs them from speakers corresponding to these channels.

The prescribed measuring signals emitted from the speakers are collected by the microphones 6*a*, 6*b* and inputted to the microphone amplifier units 34*a*, 34*b*. The microphones 6*a*, 6*b* are set so as to collect sound at a listening position (corrected position) where the best corrected sound field is expected to obtain in the listening environment. For example, as shown in FIG. 2, the position of the microphones 6*a*, 6*b* can be set at the almost center in the listening environment, or in the case that the audio set 1 is in-vehicle equipment, it is preferable that the microphones 6*a*, 6*b* are set at a position of ears when the user sits on a driver's seat so that the user can obtain the best sound field when listening at the driver's seat, and that audio characteristics collected at the position are analyzed.

Ambient environmental sound including the measuring tone is collected by the microphones 6*a*, 6*b* and amplified at the microphone amplifiers 34*a*, 34*b* to be inputted to the measuring units 331*a*, 331*b* in the measuring processing block 33. The measuring units 331*a*, 331*b* performs A/D conversion of the inputted audio signals, and performs various signal processing such as impulse response processing of a system from the speaker to the microphone, the frequency analysis by FFT with respect to the obtained signals. As results of these processing, in addition to information such as distances from speakers of respective channels to the setting position of the microphones 6*a*, 6*b*, measured results concerning terms which will be necessary for generating the sound field can be obtained.

The speaker position calculating unit 333 executes processing of specifying position coordinates of respective speakers in the listening environment based on the measured results measured in the measuring units 331*a*, 331*b*.

As a specific example of measuring processing in the measuring processing block 33, configurations and operations of the audio sets 1 for measuring distances between respective arranged speakers and the listening position, namely, the microphones 6*a*, 6*b* will be described.

The distances between the speakers and the listening position arranged in the listening environment of the audio set 1 can be represented by information based on reaching time from respective speakers corresponding to audio channels to the listening position. Specifically, distance information from speakers to the listening position can be converted into time differences generated according to distances by using propagating velocity of sound waves (sound velocity), and the delay time information can be used as a coefficient in a delay processing unit 321 in the sound field correction processing block 32. To correct the arrival time differences generated by the distances from speakers to the listening position using time delay amounts which are given when generated from speakers is called as time alignment. For generating the realistic sound field in the listening point in the listening environment, it is necessary to adjust the time alignment in that point.

As a method for measuring the distances from respective speakers to the listening point, the following method can be cited. First, plural speakers provided in the audio set 1 are measured one by one in sequence. The measuring tone signal is outputted from the speaker 51. As the measuring tone signal, a TSP (Time Stretched Pulse) signal having a prescribed frequency band characteristic can be used. The TSP signal is generated at the measuring tone processing unit 332 and collected by the microphones 6*a*, 6*b* set corresponding to the listening position (that is, the corrected position). It is inputted to the measuring units 331 through the microphone amplifiers 34*a*, 34*b*. The measuring units 331*a*, 331*b* obtain sampling data extracted as an unit of the predetermined sample size based on a waveform of the inputted audio signal. The sampling data is divided on a frequency axis by the TSP signal, further computed by inverse FFT on a time axis to make a so-called impulse response. The measuring units 331*a*, 331*b* can obtain distance information from the speaker to the listening position by executing predetermined signal processing or calculation processing for measurement and the like based on the impulse response.

The speaker position calculating unit 333 performs processing of specifying position coordinates of the speaker in the listening environment based on characteristic information obtained from the impulse response calculated by the audio signal inputted from the microphone 6*a* and characteristic information obtained from the impulse response calculated by the audio signal inputted from the microphone 6*b*.

After the position coordinates of the speakers in the listening environment are specified by the speaker position calculating unit 333, more accurate distance information and position information between speakers and the microphones 6*a*, 6*b* can be obtained based on the specified positions of respective speakers, and audio signals for creating more accurate sound field in the listening environment can be generated.

Figure 4:
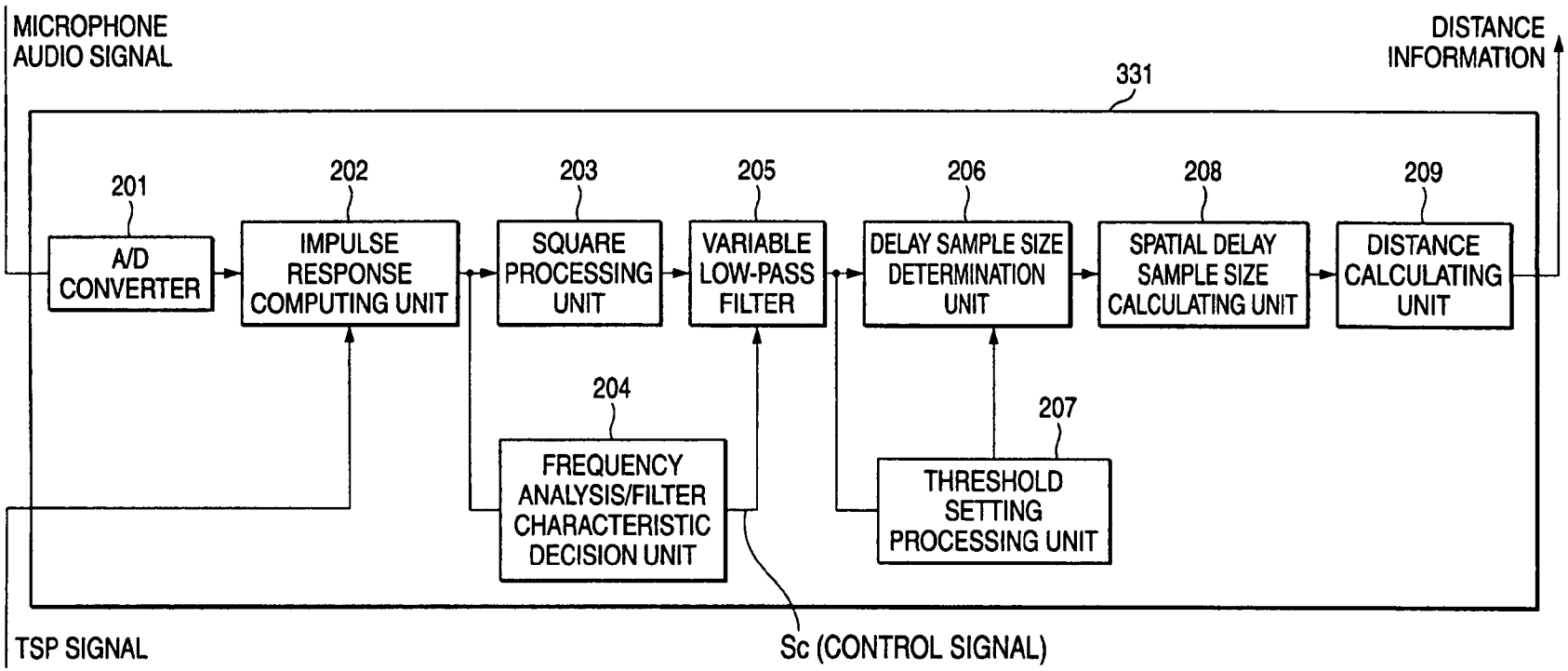
FIG. 4 is a functional block diagram for explaining processing for measuring a distance between a speaker and a microphone (listening position) by inputting impulse response of a measuring tone signal in the measuring process block of the sound field correction/measuring function unit.

Next, the measurement of the distance between the speaker and the microphones using the impulse response of a system from the speaker to the microphones will be explained. FIG. 4 shows a processing configuration for measuring the distance between the speaker to the microphones (listening position) by inputting the measuring tone signal generated at the measuring tone processing unit 332 and the impulse response calculated from the audio signals from the microphones 6*a*, 6*b* in the measuring unit 331 of the measuring processing block 33. A processing flow according to the configuration shown in FIG. 4 will be explained with reference to FIG. 5 to FIG. 8.

A microphone audio signal is supplied to the measuring units 331*a*, 331*b* through the microphone amplifiers 34*a*, 34*b*. As shown in FIG. 4, the supplied microphone audio signal is converted into a digital signal at an A/D converter 201, then, supplied to an impulse response computing unit 202. The TSP signal is also supplied to the impulse response computing unit 202, which was generated at the measuring tone processing unit 332 and collected by the microphones 6*a*, 6*b* which was set corresponding to the listening position of the user. The impulse response computing unit 202 obtains sampling data extracted as an unit of the predetermined sample size based on waveforms of the inputted audio signal, and divides the sampling data by the TSP signal on the frequency axis, further computes the data by inverse FFT on time axis to calculate the impulse response. The impulse response computing unit 202 supplies the calculated impulse response to a square processing unit 203 and a frequency analysis/filter characteristic decision unit 204.

Figure 5A:
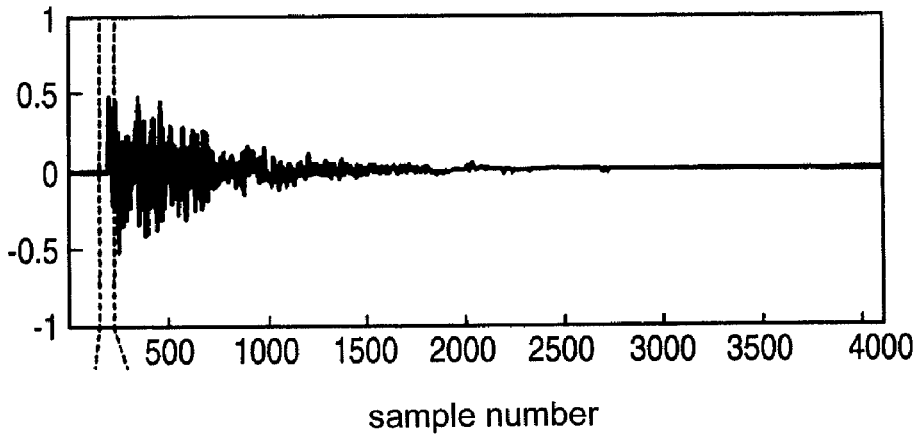
FIG. 5A is a waveform chart showing an original waveform of impulse response.
Figure 7:
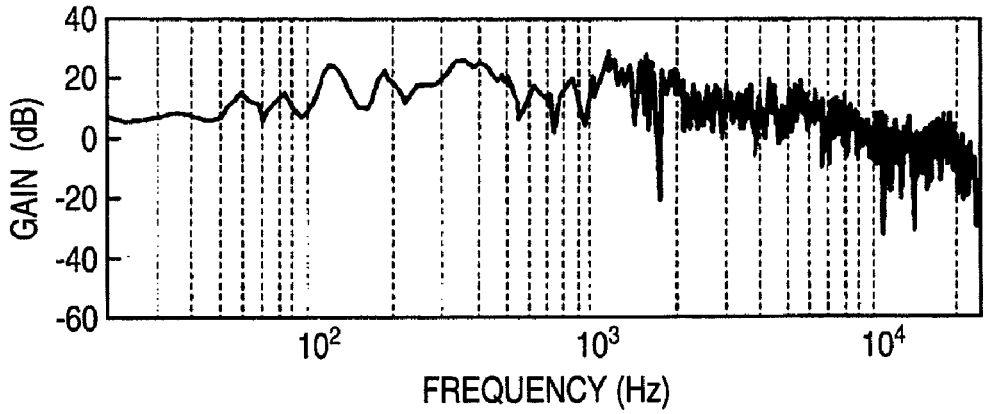
FIG. 7 is a frequency characteristic chart showing a frequency characteristic of the impulse response original waveform.

An original waveform of impulse response calculated from the audio signal of the microphones 6*a*, 6*b* inputted to the measuring units 331*a*, 331*b*, which is sampling waveform data is shown in FIG. 5A. A horizontal axis shows the sample size and a vertical axis shows the level of amplitude. A frequency characteristic of the original waveform of the impulse response is shown in FIG. 7. The original waveform of the impulse response shown in FIG. 5A has been obtained by performing sampling processing by 4096 samples. The sample size 4096 is represented as the twelve power of 2, which is set based on the fact that the sample size suitable for frequency analysis processing by, for example, FFT (Fast Fourier Transform) and the like is the power of 2. The sampling frequency "fs" is 48 kHz in this case.

As the sampling timing of the audio signal from the microphones, a sampling start point, that is, the timing that a sample point is "0" corresponds to a point when the output of the measuring tone signal is started from the measuring tone processing unit 332. Namely, the sampling timing of the audio signal collected by the microphones 6*a*, 6*b*, or all audio signals to be collected correspond to the point when the audio output from the speaker was started. Note that the impulse response is literally time response of a system for an impulse signal, therefore, there is a case that the measuring tone signal used for measurement of the impulse response is referred to as the impulse signal for convenience.

It is almost correct that the acoustic propagation distance corresponding to time from the sampling start point to a rising point of the original waveform of the impulse response shown in FIG. 5A is the distance between the speaker and the microphones to be calculated, however, in the embodiment, the following signal processing is performed in order to reduce the effect such as environmental noise and to measure the distance more accurately. Therefore, in the case of relatively good acoustic environment, the acoustic propagation distance can be calculated from the impulse response waveform directly.

Figure 5B:
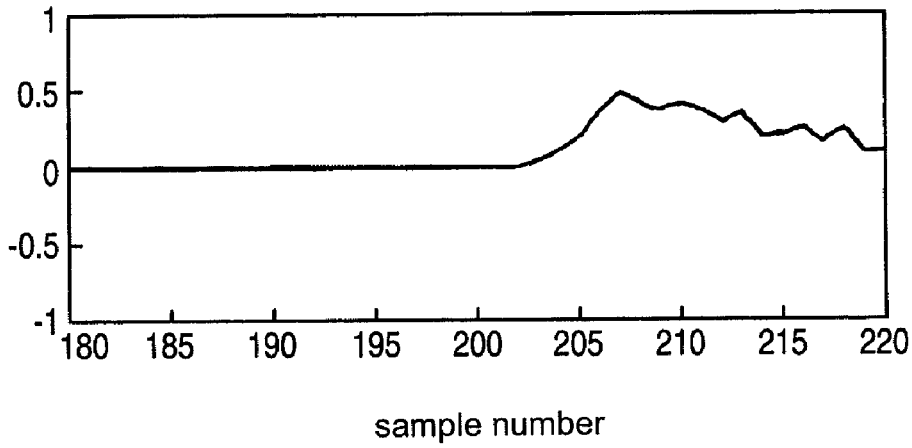
FIG. 5B is a waveform chart shown by enlarging a rising position of the impulse response original waveform shown in FIG. 5A in the horizontal axis.

A waveform shown by enlarging a rising position of the impulse response original waveform shown in FIG. 5A in the direction of the sample point (horizontal axis direction) is shown in FIG. 5B. The sampling data of the impulse response original waveform shown in FIG. 5A and FIG. 5B is inputted to the square processing unit 203 shown in FIG. 4 and also inputted to the frequency analysis/filter characteristic decision unit 204.

Figure 6A:
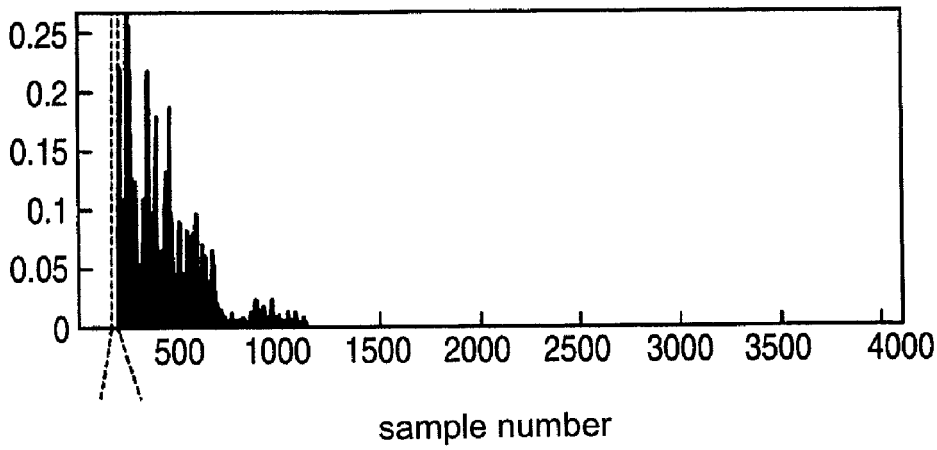
FIG. 6 is a waveform chart in which waveform data of impulse response having amplitude values of bothe positive/negative poles is squired.
FIG. 6B is a waveform chart shown by enlarging a rising position of the impulse response original waveform shown in FIG. 6A in the horizontal direction.
Figure 6B:
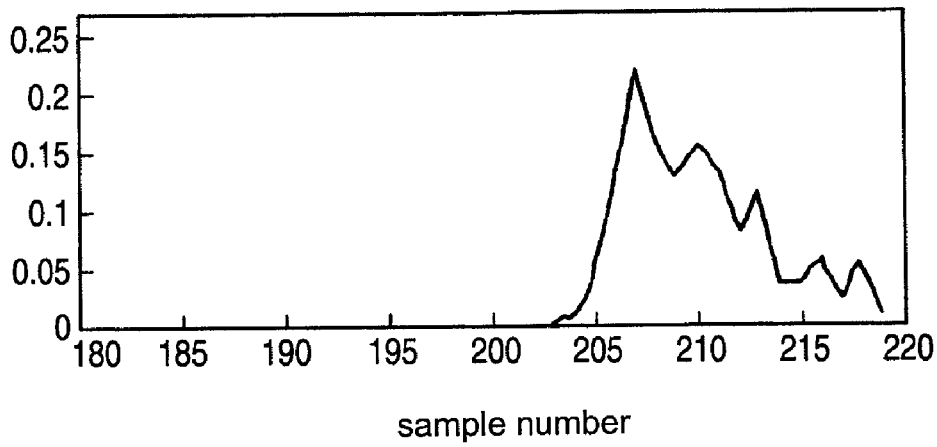

The square processing unit 203 performs square processing with respect to amplitude values of the impulse response. According to this, waveform data of the impulse response which has amplitude values of both positive/negative poles by nature is squared as shown in FIG. 6A, and negative amplitude values are reversed and folded to be positive amplitude values. In the case that the speaker is reversed-phase connected, that is, in the case that a speaker diaphragm moves to be depressed when applying the positive signal, or in the case a woofer and a tweeter are reverse-phase connected in a multi-way speaker, a first rising point of the impulse response may be directed to the negative pole. Accordingly, the square processing is performed in the embodiment in order to cover both positive phase/negative phase connection. Since negative amplitude values can be dealt with as the amplitudes of the same polarity as positive amplitude values in sequent processes, the measurement only covering the positive pole level should be performed when measurement of impulse response amplitude values which is described later. A waveform shown by enlarging a rising position of the impulse response original waveform shown in FIG. 6A in the direction of the sample point (horizontal axis direction) is shown in FIG. 6B.

The sampling data is transferred to a variable low-pass filter 205. The variable low-pass filter 205 receives the sampling data of impulse response according to square series, which is the output of the square processing unit 203. The variable low-pass filter 205 is provided to obtain an envelope waveform suitable for the measuring target by cutting high frequency components to be dealt with as noise with respect to the impulse response sampling data (square waveform) to which the square processing was applied. However, in some filter characteristics, the whole envelope waveform including the rising of impulse response becomes too smooth. Therefore, the filter provided in the embodiment is a variable low-pass filter which can be varied suitably according to frequency characteristics of impulse response.

The frequency analysis/filter characteristic decision unit 204 analyzes the frequency of the inputted sampling data of impulse response original waveform using, for example, FFT. Needless to say, the inverse FFT computing has been performed in the previous stage of calculating the impulse response, therefore, spectral data before the inverse FFT computing can be utilized as it is. The balance of amplitude values between a middle frequency band and a high frequency band is judged based on the frequency characteristic (frequency response) obtained by the frequency analysis, and a filter characteristic of the variable low-pass filter 205 is decided to optimal values according to the judged result.

Figure 8:
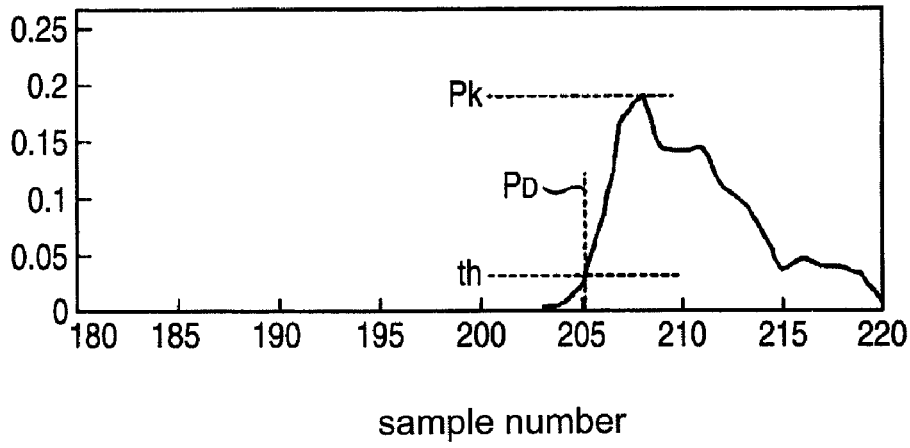
FIG. 8 is a waveform chart showing a signal waveform after passing through the variable low-pass filter in the sound field correction/measurement function unit.

A signal waveform after passing through the variable low-pass filter 205 is shown in FIG. 8. The envelope sampling data shown in FIG. 8 is inputted to a delay sample size determination unit 206 and the threshold setting processing unit 207 respectively. The threshold setting processing unit 207 calculates a peak level "Pk" from the sampling data of the low-pass filtered waveform shown in FIG. 8, and sets a level value of amplitude calculated by a prescribed rate with respect to the peak level "Pk" as a threshold "th". The threshold setting processing unit 207 notifies the set threshold "th" to the delay sample size determination unit 206.

The delay sample size determination unit 206 detects a sample point at which the low-pass filtered waveform becomes more than the threshold "th" for the first time, taking the sample point "0" as a start point by comparing amplitude values of the sampling data of the low-pass filtered signal waveform shown in FIG. 8 with the notified threshold "th". In FIG. 8, the detected sample point is indicated as a delay sample point "PD". The delay sample point "PD" represents time delay by the sample size, taking the sample point "0" corresponding to the audio output start point of the impulse signal from the speaker as a start time, until the point at which the impulse response rises. The delay sample point PD is accurately detected without generating an error by the variable low-pass filter 205 in which the appropriate filter characteristic is set by control of the frequency analysis/filter characteristic decision unit 204.

Information of the delay sample point "PD" determined by the delay sample size determination unit 206 as described above is notified to a spatial delay sample size calculation unit 208. The delay sample point "PD" represents time delay by the sample size, taking the audio output start point of the impulse signal from the speaker as the start point, until the point at which the impulse response rises, which was obtained by collecting audio of the impulse signal by microphones. In short, the delay sample point "PD" represents the distance between the speaker and the microphones in time scale.

However, in fact, there is so-called system delay such as filter delay, processing delay caused by A/D or D/A conversion processing, between a signal output system for outputting the impulse signal from the speaker and a signal input system for collecting audio outputted from the speaker by microphones and performing sampling to obtain sampling data of the impulse response original waveform. The delay sample point "PD" determined by the delay sample size determination unit 206 includes errors caused by the system delay and the like. The system delay to be a factor of these errors is measured in advance, and recorded in storage media and the like included in the measuring processing block 33. Accordingly, the spatial delay sample size calculation unit 208 obtains the true delay sample size (hereinafter, referred to as the spatial delay sample size) corresponding to the distance between the speaker to the microphone (listening position) by subtracting errors caused by the system delay and the like from the delay sample point "PD". Information of the spatial delay sample size obtained at the spatial delay sample size calculation unit 208 is notified to a distance calculating unit 209.

The distance calculating unit 209 converts the notified spatial delay sample size to a time scale. Then, the distance between the speaker to the microphones is calculated by using a prescribed computing formula based on information of the spatial delay sample size which has been converted to the time scale and values indicating sound velocity and the like. The information of the calculated distance between the speaker and the microphone is stored in a nonvolatile memory and the like provided in the control unit 7 after the speaker as the measuring target is associated with an audio channel outputted by the speaker.

The control unit 7 determines the spatial differences of reaching time of audio from the speakers of respective audio channels to the listening point according to the distance difference based on difference of the distances between the speakers of respective audio channels to the microphones. The control of setting prescribed delay constants to respective audio channels is performed in the delay processing unit 321 based on the above determination results so as to eliminate the differences of reaching time of audio from respective speakers corresponding to the audio channels to the listening position. The delay processing unit 321 executes delay processing for respective audio signals set by the control unit 7. As a result, a sound field in which differences of reaching time of audio caused by differences of distances between speakers and the listening point are canceled is generated in the appropriate listening position. That is, the sound field in which the time alignment is suitably corrected in the listening position is generated.

Figure 9:
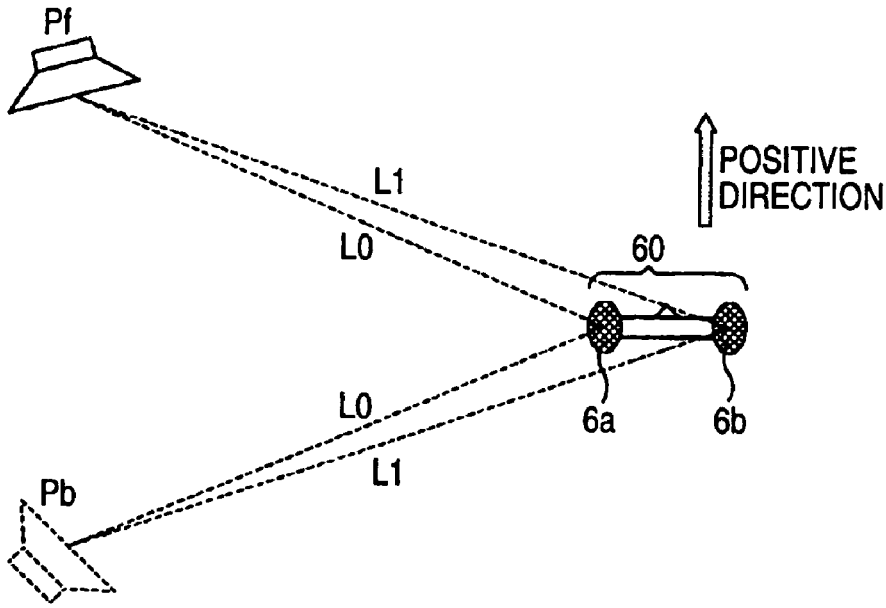
FIG. 9 is a schematic view explaining distances and positional relationship between microphones and speakers as sound sources.
Figure 10:
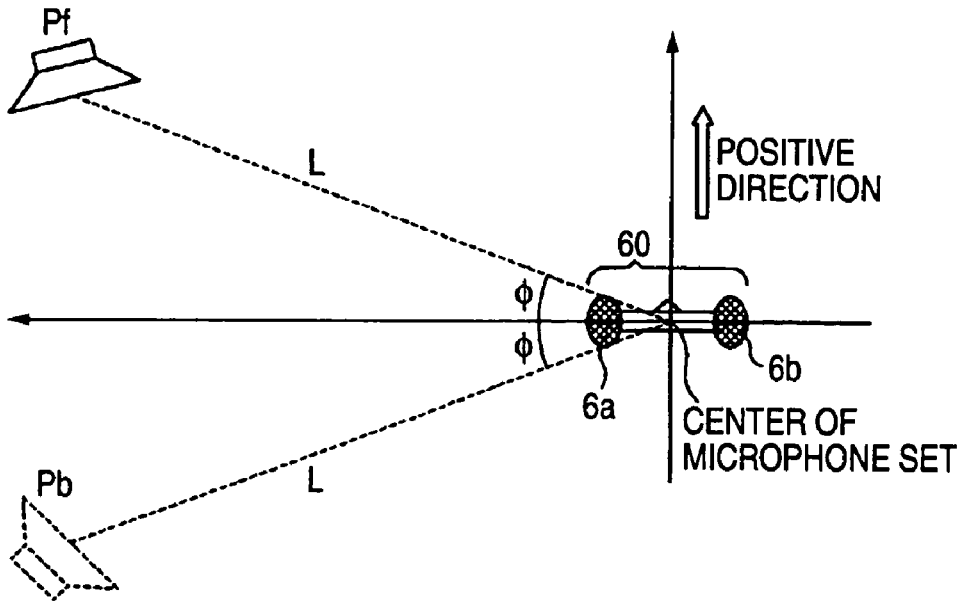
FIG. 10 is a schematic view explaining distances and positional relationship between microphones and speakers as sound sources.

Subsequently, specific methods for specifying speaker positions in the listening environment in the above sound field measuring processing and sound field generating processing will be explained with respect to FIG. 9 to FIG. 17. FIG. 9 and FIG. 10 explain distances and positional relationship between the microphones and speakers as sound sources.

The listening environment in the embodiment is the interior of a car or the interior of a small room, which is the case that the microphones 6*a*, 6*b* are set at a position not so far from speakers, therefore, it can be supposed that the characteristic difference of collecting sound according to conditions in the listening environment, such as standing waves or reflection by walls and the like with respect to the positional relationship between the microphones and speakers is little. Specifically, it is preferable that the sample size is set to the time length (4096 points in the above example) in which taking microphone signals is finished before the impulse signal emitted from the speaker reaches the microphone, then, a first reflection sound enters the microphone. Further, the microphones 6*a* and the microphone 6*b* are fixed to each other at an interval in which the characteristic difference according to setting positions in the listening environment does not appear.

When the center of the microphone set 60, namely, the middle point between the microphones 6*a*, 6*b* is the origin of coordinates (standard position), a direction in which a speaker corresponding to the center channel (C) is set is make to be a positive direction of the microphone set 60, which is a positive direction in coordinate axes. For example, even when distances "L0", "L1" between the microphones 6*a*, 6*b* and respective speakers are calculated according to the above method, it is actually difficult to specify that the set speaker is arranged at which position, that is, a forward position "Pf" with respect to the microphone set 60 or a backward position "Pb" with respect to the microphone set 60 as shown in FIG. 9.

The positions of speakers with respect to the microphone set 60 can be expressed by vectors having a distance "L" and an angle ϕ from the origin. Even if all speakers are assumed to be on the same two-dimensional plane (for example, on a horizontal place), as directions of the speakers with respect to the microphone set 60, two positions corresponding to conditions are surely calculated, therefore, it is not possible to specify the position.

Accordingly, in the audio set 1 shown as the embodiment of the invention, concerning either one speaker in plural speakers, the absolute value of a distance between the microphone and the speaker is calculated as positive direction coordinates of the center of the microphone set with respect to the speaker when the speaker in the playback environment is taken as the origin, then, candidates for a position of a different speaker (second speaker) from the speaker used as the origin with respect to the microphone set in the playback environment are calculated in a coordinate system of the speaker of the origin.

The audio set 1 specifies position coordinates of the second speaker by comparing candidates of position coordinates of the second speaker calculated from audio signals outputted from the second speaker in plural speakers, which are collected by the microphone set positioned at an arbitrary position/direction (first arrangement) in the listening environment with candidates of position coordinate of the second speaker calculated from audio signals outputted from the second speaker, which are collected by the microphone set positioned at a position/direction (second arrangement) different from the arbitrary position in the listening environment.

As described above, the audio set 1 supports the 5.1 channel surround system, therefore, speakers 51, 52, 53, 54, and 55 prepared for respective channels (in this case, a subwoofer channel is not shown) are directed to a listener placed inside a space surrounded by these multichannel speakers, and usually arranged with diaphragms thereof being directed to the listener. In some speakers, diaphragms of which are directed upward or in directions different from the direction to the listener, however, the direction is not confined. It is assumed that respective speakers are fixed during a series of speaker position calculation processing, and not moved during measurement.

Hereinafter, speaker position calculation processing will be explained with reference to the drawings. In the embodiment, the microphone set 60 is arranged so that the positive direction thereof is directed to the direction of the center speaker 51 in the listening environment. That is, it is arranged so that the microphones 6*a*, 6*b* are at almost equal distance with respect to the center speaker 51. When the direction in which the center speaker 51 which outputs the center channel (C) shown in FIG. 2 is set is a front direction (positive direction), and position coordinates of the center speaker 51 are coordinates of the origin S0 (0, 0) in the listening environment, a position coordinates of the microphone 60 arranged first at an arbitrary position can be calculated uniquely, taking the center speaker 51 as a standard.

Figure 11:
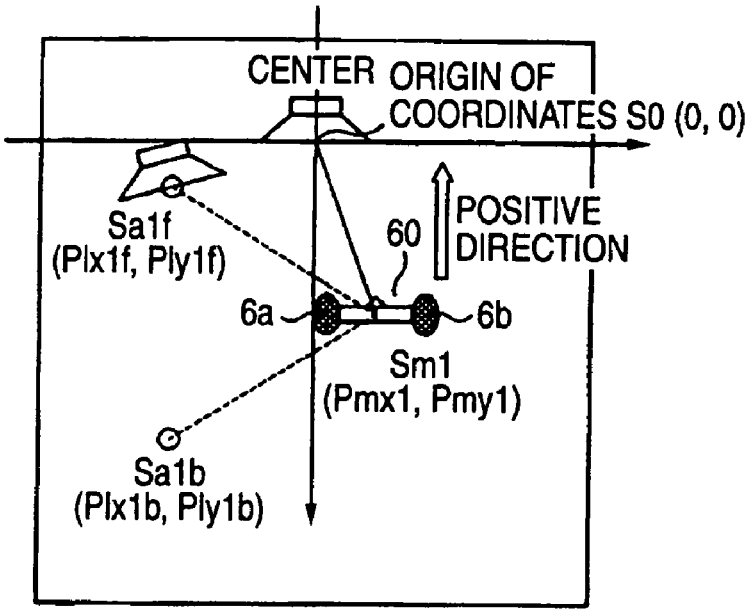
FIG. 11 is a conceptual diagram explaining candidates for position coordinates of a second speaker calculated from audio signals collected by a microphone set positioned at coordinates Sm1 (Pmx1, Pmy1)

The speaker position calculating unit 333 calculates the absolute value of a distance between the microphone and speaker calculated at the distance calculating unit 209 with respect to the center speaker 51 in plural speakers according to an instruction from the control unit 7. The speaker position calculating unit 333 calculates position coordinates of the microphone set 60 as positive direction coordinates (positive direction area), taking the center speaker 51 as the origin. At this time, as shown in FIG. 11, coordinates Sm1 (Pmx1, Pmy1) are calculated, which are the center position of the microphone set 60 with respect to the center speaker 51, namely, the origin of coordinates. When the distance between the center speaker 51 and the microphones 6*a*, 6*b* is measured, two candidate points are calculated as shown in FIG. 9 and FIG. 10, however, since the center speaker 51 is arranged so as to be in the positive direction area of the microphone set 60, it is determined that the center speaker 51 is arranged at a candidate point existing in the positive direction area in the two candidates. A squire frame in FIG. 11 and other drawings indicates a range of the listening environment, for example, walls of a room.

Subsequently, the control unit 7 calculates candidates for a position of the second speaker with respect to the microphone set 60 in the listening environment in the coordinate system where the center piece 51 is the origin. The measuring unit 331 and the speaker position calculating unit 333 calculate the candidates for the position coordinates of the second speaker from audio signals outputted from the second speaker in plural speakers, which are collected by the microphone set 60 positioned at the coordinates Sm1 (Pmx1, Pmy1) in the listening environment. At this time, as the candidates for the position coordinates of the second speaker, coordinates Sa1*f* (Plx1*f*, Ply1*f*), Sa1*b* (Plx1*b*, Ply1*b*) are calculated.

Figure 12:
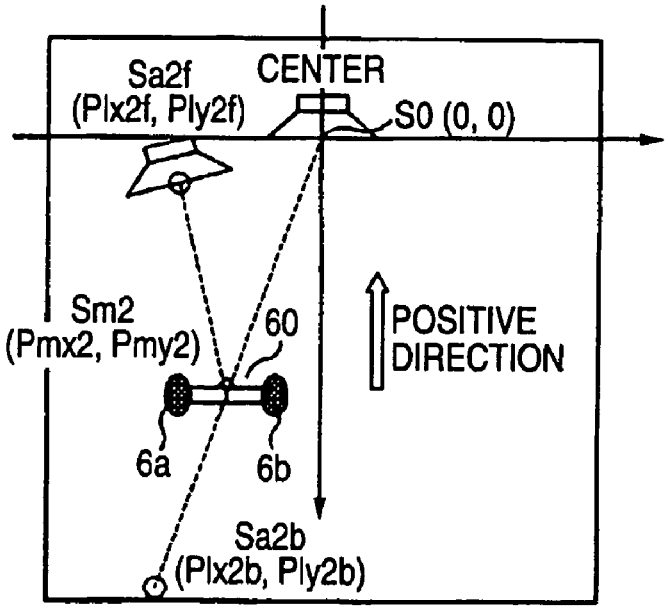
FIG. 12 is a conceptual diagram explaining candidates for position coordinates of a second speaker calculated from audio signals collected by a microphone set positioned at coordinates Sm2 (Pmx2, Pmy2)

Then, the microphone set 60 is moved to a different position from the first-arranged arbitrary position. Position coordinates of the microphone set 60 after moved can be calculated uniquely in the same way as the above case, taking the center speaker 51 as the standard. Specifically, the speaker position calculating unit 333 calculates the absolute value of the distance between the microphone to speaker calculated in the distance calculating unit 209 with respect to the center speaker 51 according to an instruction from the control unit 7. The speaker position calculating unit 333 calculates position coordinates of the microphone set 60 as positive direction coordinates, taking the center speaker 51 as the origin. At this time, as shown in FIG. 12, coordinates Sm2 (Pmx2, Pmy2) which are the center position of the microphone set 60 with respect to the center speaker 51, namely, the origin of coordinates are calculated.

The control unit 7 calculates candidates for the position of the second speaker with respect to the microphone set 60 in the listening environment in the coordinate system where the center speaker 51 is the origin. Specifically, the measuring unit 331 and the speaker position calculating unit 333 calculate the candidates for the position coordinates of the second speaker from audio signals outputted from the second speaker in plural speakers, which are collected by the microphone set 60 positioned at the coordinates Sm2 (Pmx2, Pmy2) in the listening environment. At this time, as the candidates for the position coordinates of the second speaker, coordinates Sa2*f* (Plx2*f*, Ply2*f*), Sa2*b* (Plx2*b*, Ply2*b*) are calculated.

The control unit 7 compares the candidates for the position coordinates of the second speaker which were calculated when the microphone set 60 was positioned at the center coordinates Sm2 (Pmx2, Pmy2) with the candidates for the position coordinates of the second speaker calculated when the microphone set 60 was positioned at the center coordinates Sm1 (Pmx1, Pmx2), and specifies the position coordinates of the second speaker. In the case that the speakers are arranged as shown in FIG. 2, Sa1*f* (Plx1*f*, Ply1*f*) will be equal to Sa2*f* (Plx2*f*, Ply2*f*). Therefore, as a result that the measurement was performed at two points by moving the position of the microphone set 60, the coincident coordinates can be specified as the position coordinates of the speaker. Basically, when the similar measurements are performed at least at two points in the listening environment by changing the position of the microphone set 60, the position coordinates of one speaker can be specified.

In fact, calculated coordinates of a speaker position includes some errors due to factors such as directional characteristics of speakers, existence of reflection wall surfaces in the vicinity of speakers, environmental noise, however, the control unit 7 decides the position of the second speaker when it has been confirmed that Sa1*f* (Plx1*f*, Ply1*f*) and Sa2*f* (Plx2*f*, Ply2*f*) are "sufficiently proximate values" including errors as well as it has been confirmed that Sa1*b* (Plx1*b*, Ply1*b*) and Sa2*b* (Plx2*b*, Ply2*b*) are "not sufficiently proximate values". A threshold for the decision can be selected depending on the listening environment in which the audio set 1 is used, or accuracy required according to the listening environment and the like.

In the process of specifying the position coordinates of one speaker, when the microphone set 60 is moved from the first position (FIG. 11) to the second position (FIG. 12), the movement destination may be an arbitrary position when it is in the listening environment surrounded by speakers 51, 52, 53, 54, and 55. For example, it is preferable that the difference between the position of the microphone set 60 after moved and the original position is large. It is also preferable that the position of the microphone set 60 after moved and the original position are not on a line connecting the microphone 6*a* and microphone 6*b*.

Figure 13:
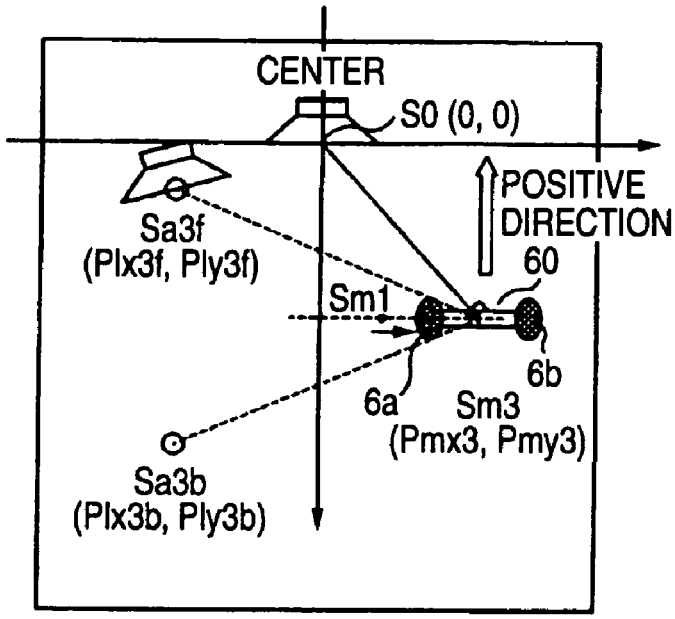
FIG. 13 is a conceptual diagram explaining candidates for position coordinates of a second speaker calculated from audio signals collected by a microphone set positioned at coordinates Sm3 (Pmx3, Pmy3)

An example of the above is shown in FIG. 13. After candidates for position coordinates of the second speaker are calculated from audio signals collected by the microphone set 60 positioned at coordinates Sm1 (Pmx1, Pmy1), if the microphone set 60 is moved along an axis connecting the microphone 6*a* and 6*b*, for example, as shown in FIG. 13, when the position of the microphone set 60 after moved is Sm3 (Pmx3, Pmy3) which is on the axis connecting the microphone 6*a* and 6*b*, the candidates for position coordinates of the second speaker Sa1*f* (Plx1*f*, Ply1*f*) and Sa1*b* (Plx1*b*, Ply1*b*) which have been calculated when the microphone set 60 was positioned at the coordinates Sm1 (Pmx1, Pmy1) and candidates for position coordinates of the second speaker Sa3*f* (Plx3*f*, Ply3*f*) and Sa3*b* (Plx3*b*, Ply3*b*) which have been calculated when the microphone set 60 was positioned at coordinates Sm3 (Pmx3, Pmy3) will be the same values both in the positive direction and the negative direction, the position of the speaker cannot be specified. It is not effective also in a case that candidates for the position coordinates of the speaker to be calculated are included in an error range when the difference between the position of the microphone set 60 after moved and the original position is small.

In the case that acoustic distance measurements are performed at plural positions, that is, more than two positions in the listening environment for the purpose of improving the accuracy of speaker positions, the case in which the difference between the position of the microphone set 60 after moved and the original position is small, and the case in which the microphone set 60 moves along the axis connecting two microphones may be included because they can be thrown away as redundant data.

In the first method, position coordinates of speakers can be decided in sequence as described above. The order of calculating the positions of respective speakers may be decided by executing the process for deciding coordinates with respect to every speaker, or decided at the same time. It is preferable that, after the microphone set 60 is set at the first place/direction (first arrangement) in the listening environment and candidates for position coordinates of all speakers with respect to the first arrangement are calculated, the user is proposed to move the position of the microphone set 60, and after the user moves the microphone set 60 to the second arrangement, candidates for position coordinates of all speakers with respect to the second arrangement are calculated in the same way, and finally, the candidates for position coordinates of the speakers in the first arrangement and the candidates for position coordinates of the speakers in the second arrangement are compared to specify position coordinates of respective speakers. Additionally, whether the second speaker is the speaker 52 for the front left channel (FL) shown in FIG. 2 or not can be decided by being associated from position relationship of all speakers after position coordinates of all speakers are calculated. It is also preferable that, the speaker to be the target for deciding position coordinates is designated by the audio set 1 and position coordinates are calculated with respect to designated each speaker in such a manner that processing of deciding position coordinates is performed such that audio is outputted only from the front left channel speaker 52 after the center speaker 51, then, processing of deciding position coordinates is performed such that audio is outputted only from the front right channel speaker 53, and so on.

Figure 14:
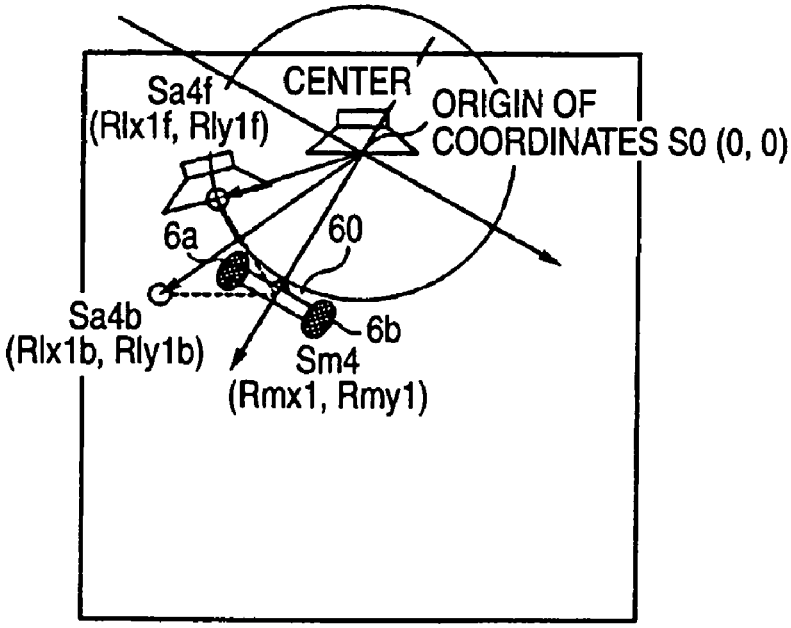
FIG. 14 is a conceptual diagram explaining candidates for position coordinates of a second speaker calculated from audio signals collected by a microphone set positioned at coordinates Sm4 (Rmx1, Rmy1)
Figure 15:
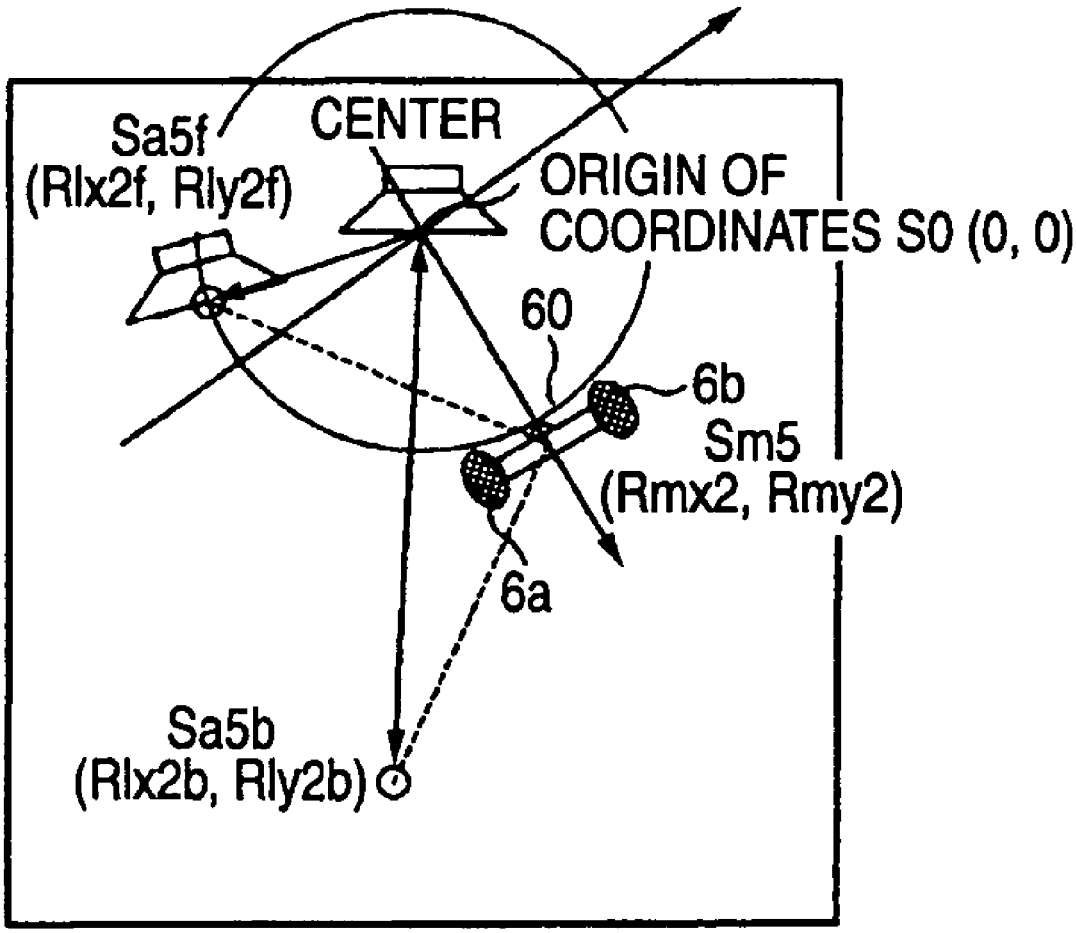
FIG. 15 is a conceptual diagram explaining candidates for position coordinates of a second speaker calculated from audio signals collected by a microphone set positioned at coordinates Sm5 (Rmx2, Rmy2)

Next, a second method for specifying speaker positions in the listening environment will be explained with reference to FIG. 14 and FIG. 15. In the first method, the case that the center speaker 51 is arranged in almost the positive direction of the microphone set 60 and measurements are performed by moving the microphone set 60 in the axial direction, however, it is also possible to specify the speaker positions by performing acoustic distance measurements at plural points in the listening environment under a condition that the microphones 6*a*, 6*b* forming the microphone set 60 and the center of the center speaker 51 are arranged so that the distances therebetween are almost equal. Specifically, as shown in FIG. 14 and FIG. 15, the second position (FIG. 15, Sm5) with respect to the first position (FIG. 14, Sm4) is on a circumference whose radius is a distance between the acoustic center of the center speaker 51 and the microphone 6*a*, and a distance between the acoustic center of the center speaker 51 and the microphone 6*b*.

In the same way as the first embodiment, a direction in which the center speaker 51 which outputs the center channel (C) shown in FIG. 2 is made to be a front direction (positive direction) with respect to the microphone set 60, and position coordinates of the center speaker 51 is made to be the origin of coordinates S0 (0, 0) in the listening environment. In this case, position coordinates of the microphone set 60 which is first arranged at an arbitrary position can be calculated uniquely by taking the center speaker 51 as a standard.

The speaker position calculating unit 333 calculates the absolute value of the microphone to the speaker calculated at the distance calculating unit 209 with respect to the center speaker 51 in plural speakers according to an instruction by the control 7. At this time, the speaker position calculating unit 333 calculates position coordinates of the microphone set 60 as coordinates in the positive direction, taking the center speaker 51 as the origin. As shown in FIG. 14, position coordinates Sm4 (Rmx1, Rmy1) of the center of the microphone set 60 with respect to the origin of coordinates is calculated.

Subsequently, the control unit 7 calculates candidates for a second speaker position with respect to the microphone set 60 in the listening environment is calculated in the coordinate system where the center speaker 51 is the origin. The measuring unit 331 and the speaker position calculating unit 333 calculate candidates for position coordinates of the second speaker from audio signals outputted from the second speaker in plural speakers, which are collected by the microphone set 60 positioned at coordinates Sm4 (Rmx1, Rmy1) in the listening environment. At this time, as candidates for position coordinates of the second speaker, coordinates Sa4*f* (Rlx1*f*, Rly1*f*), Sa4*b* (Rlx1*b*, Rly1*b*) are calculated.

Subsequently, the audio set 1 advises the user to move the microphone set 60 to a position different from the first-arranged arbitrary position, which is on the circumference whose radius is the distance between the acoustic center of the center speaker 51 and the microphone 6*a* as well as the distance between the center of the center speaker 51 and the microphone 6*b*. Specifically, the microphone set 60 is moved so that the acoustic center of the center speaker 51 is in the positive direction of the microphone set 60. At this time, it is also preferable to advise the user whether the microphone set 60 has been moved to the optimum position by calculating the distance to the center speaker 51 at the distance calculating unit 209, so that the microphone set 60 can be arranged on a point of the circumference more accurately. However, as described later, it is not necessary to exactly set the distance between the center speaker 51 and the microphones 6*a*, 6*b*, and it can be roughly set for practical use.

The position coordinates of the microphone set 60 after moved can be calculated uniquely by taking the center speaker 51 as a standard in the same way as the above. Specifically, the speaker) position calculating unit 333 calculates the absolute value of the distance between the microphone and the speaker calculated in the distance calculating unit 209 with respect to the center speaker 51 according to an instruction by the control unit 7. The speaker position calculating unit 333 calculates position coordinates of the microphone set 60 as coordinates in the positive direction, taking the center speaker 51 as the origin. At this time, as shown in FIG. 15, coordinates Sm5 (Rmx2, Rmy2) of the center position of the microphone set 60 with respect to the center speaker 51, namely, the origin of coordinates is calculated.

The control unit 7 calculates candidates for a position of the second speaker with respect to the microphone set 60 in the listening environment in the coordinate system where the center speaker 51 is the origin. The measuring unit 331 and the speaker position calculating unit 333 calculate candidates for position coordinates of the second speaker from audio signals outputted from the second speaker in plural speakers, collected by the microphone set 60 positioned at the coordinates Sm5 (Rmx2, Rmy2) in the listening environment. In this case, as candidates for position coordinates of the second speaker, coordinates Sa5*f* (Rlx2*f*, Rly2*f*), Sa5*b* (Rlx2*b*, Rly2*b*) are calculated.

Then, the control unit 7 specifies position coordinates of the second speaker by comparing distances between the candidates of the position coordinates of the second speaker and the center speaker 51, which have been calculated when the microphone set 60 was positioned at the center coordinates Sm5 (Rmx2, Rmy2) with distances between the candidates of the position coordinates of the second speaker and the center speaker 51, which have been calculated when the microphone set 60 was positioned at the center coordinates Sm4 (Rmx1, Rmy1). In the case that the speakers are arranged as shown in FIG. 2, (distance between "S0" and Sa4*f*) will be equal to (distance between "S0" and Sa5*f*). In this case, a distance between "S0" and Sa4*b* are quite different from a distance between "S0" and Sa5*b*.

Accordingly, measurements are performed at least at two points by moving the position of the microphone set 60 on the circumference whose radius is the distance between the center of the center speaker 51 and the microphone 6*a* and the distance between the center of the center speaker 51 and the microphone 6*b*, and coincident coordinates can be specified as the position coordinates of the speaker. In the second method, it becomes easier to match the position of the microphone set 60 to the corresponding candidate as the number of speakers increase, which makes the final decision of the speaker positions easy.

In the second specific example, the microphone set 60 is rotarionally moved with a fixed distance between the center speaker 51 and the microphones 6*a*, 6*b* to make explanation easy, however, since two candidates for position coordinates of the speaker to be calculated are in line-symmetric positions with a center axis connecting the microphone 6*a* and 6*b*, as a modification example of the second specific example, the distance between the center speaker 51 and the microphones 6*a*, 6*b* may be varied after movement. The modification example of the second specific example is an example in which a distance between the acoustic center of the center speaker 51 and the microphone set 60 (axis connecting the microphone 6*a* and 6*b*) changes from a first position to a second position.

Figure 16:
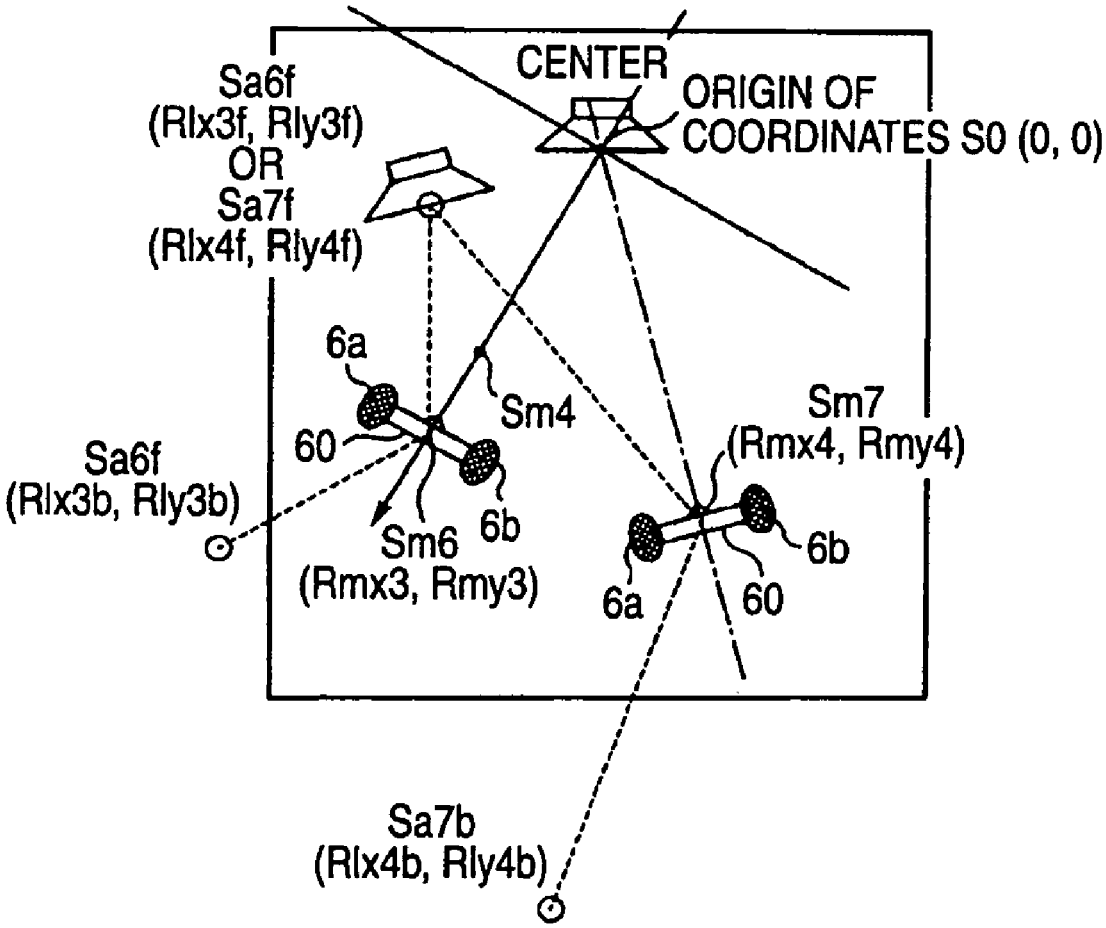
FIG. 16 is a conceptual diagram explaining a specific example in which distances between a center speaker and two microphones are different when comparing before and after movement.

The specific example is shown in FIG. 16, in which the distance between the center speaker 51 and the microphones 6*a*, 6*b* changes after movement of the microphones. It is obvious, in the explanation referring to FIG. 14, that the coordinates Sm4 (Rmx1, Rmy1) which is the center position of the microphone set 60 with respect to the center speaker 51, namely, the origin of coordinates is calculated. In this case, the microphone set 60 is supposed to be moved so that the center position of the microphone set 60 is on an extension of the coordinate origin "S0" and the coordinates Sm4.

Position coordinates of the microphone set 60 after moved can be calculated uniquely, taking the center speaker 51 as a standard in the same way as the above, at this time, position coordinates Sm6 (Rmx3, Rmy3) of the center of the microphone set 60 is calculated. The control unit 7 calculates candidates for position coordinates of the second speaker from audio signals collected from the microphone set 60 position at the coordinates Sm6 (Rmx3, Rmy3). In this case, as candidates for position coordinates of the second speaker, coordinates Sa6*f* (Rlx3*f*, Rly3*f*), Sa6*b* (Rlx3*b*, Rly3*b*) are calculated. The control unit 7 can specify position coordinates of the second speaker by comparing distances between candidates for position coordinates of the second speaker and the center speaker 51, which have been calculated when positioned at Sm6 (Rmx2, Rmy2) with distances between candidates for position coordinates of the second speaker and the center speaker 51, which have been calculated when positioned at the center coordinates Sm4 (Rmx1, Rmy1).

In the modification example of the second example, it is preferable that, in the first position (FIG. 14, Sm4) and the second position (FIG. 16, Sm6), position relationship between the acoustic center of the center speaker 51 and the axis connecting the microphone 6*a* and 6*b* is in a correct position, and it is not always necessary that the second position is on the extension of the line connecting coordinate origin and the coordinates Sm4.

Specifically, as shown in FIG. 16, a position of the microphone set 60 after moved is supposed to be Sm7. In this case, position coordinates of the microphone set 60 after moved can be found uniquely, taking the center speaker 51 as a standard in the same way as the above, and Sm7 (Rmx4, Rmy4) is calculated. The control unit 7 calculates candidates for position coordinates of the second speaker from audio signals collected by the microphone set 60 positioned at the coordinates Sm7 (Rmx4, Rmy4). At this time, as candidates for position coordinates of the second speaker, coordinates Sa7*f* (Rlx4*f*, Rly4*f*), Sa7*b* (Rlx4*b*, Rly4*b*) are calculated. The control unit 7 can specify position coordinates of the second speaker by comparing distances between candidates for position coordinates of the second speaker and the center speaker 51, which have been calculated when positioned at Sm7 (Rmx4, Rmy4) with distances between the candidates for position coordinates of the second speaker and the center speaker 51, which have been calculated when positioned at Sm4 (Rmx1, Rmy1).

Next, a third method for specifying speaker positions in the listening environment will be explained. As shown in FIG. 11, the position coordinates Sm1 (Pmx1, Pmy1) which is the center position of the microphone 60 with respect to the coordinate origin is calculated in the same way as shown in the above first specific example. Then, the microphone set 60 is rotated at a predetermined angle (for example, 30 degrees) while the center position of the microphone set 60 is at the coordinates Sm1 (Pmx1, Pmy1) as it is. When candidates for position coordinates of the second speaker are calculated in this state, one position coordinates Sa1*f* (Plx1*f*, Ply1*f*) are not changed but the other position coordinates Sa1*b* (Plx1*b*, Ply1*b*) are changed in a large scale. The position coordinates Sa1*f* (Plx1*f*, Ply1*f*) which are not changed are selected as the position coordinates of the second speaker.

Figure 17:
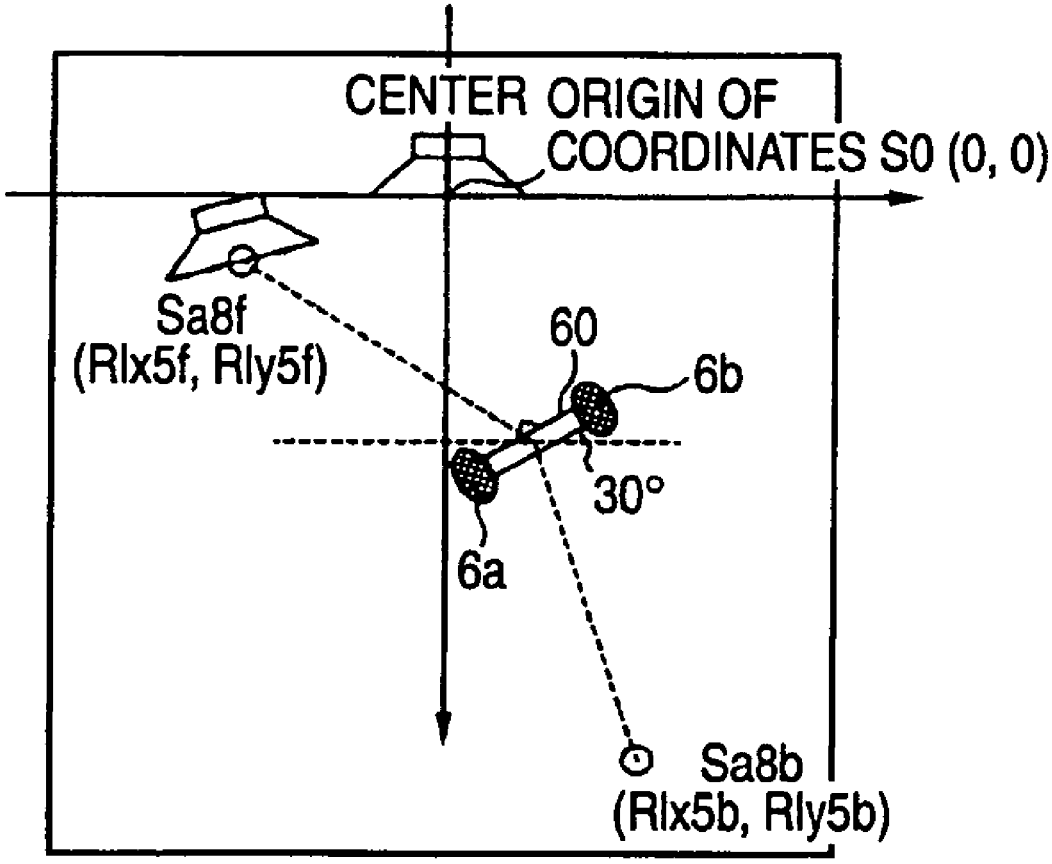
FIG. 17 is a conceptual diagram explaining a case in which candidates for position coordinates of a second speaker are calculated as a second arrangement by rotating the microphone set at the same position before movement at a predetermined angel.

The case in which the microphone set 60 is rotated at the same position as the position before movement to be the second arrangement and that candidates for position coordinates of the second speaker are calculated will be shown in FIG. 17. For example, when rotated 30 degrees as described above, the control unit 7 calculates coordinates Sa8*f* (Rlx5*f*, Rly5*f*), Sa8*b* (Rlx5*b*, Rly5*b*) as candidates for position coordinates of the second speaker at the position of the microphone set 60 after rotation. The control unit 7 specifies position coordinates which coincides with each other as the position coordinates of the second speaker by comparing position coordinates Sa1*f*, Sa1*b*, Sa8*f*, Sa8*b*.

As a modification example of the third specific example, the microphone set 60 may be rotated so that the rotation center thereof is the position of the microphone 6*a*, or the microphone 6*b*. Similarly, it is clear that the rotation center may be any point on the axis connecting the microphones 6*a*, 6*b*, further may be any point not on the axis.

In the first, second and third examples, the center speaker 51 is provisionally made to be the coordinate origin, however, the coordinate axis center should be fixed in a series of processes for specifying position coordinates of the speaker, and any speaker can be the coordinate origin. It is also possible to put the coordinate origin anywhere in an arbitrary space included the listening environment.

In the first specific example, the microphone set 60 is moved with the direction thereof in the positive direction or the axis direction being fixed (parallel motion). In the second specific example, the microphone set 60 is moved (rotary motion) by maintaining the distance between the microphone set 60 and the speaker as the standard (center speaker 51) with the positive direction of the microphone set 60 being directed to the speaker. In the third specific example, the microphone set 60 is rotated at the position. It is clear that measurement can be performed in a movement form combining the above. Specifically, measurement can be performed even if the microphone set 60 is moved almost freely except the peculiar case that the microphone set 60 is moved along the axis direction thereof such as from the state in FIG. 11 to the state in FIG. 13. That is to say, the measuring method of arranging positions according to the embodiment of the invention can be realized by moving at least one of the microphones 6*a*, 6*b* under the condition that the axes connecting the microphones 6*a* and 6*b* are not on the same line when comparing before and after movement of the microphone 60.

As described above, according to the audio set 1 provided with the sound field measuring apparatus shown as embodiments of the invention, setting positions of respective speakers included in the audio set 1 can be decided by the microphone set having two microphone devices. When the setting positions and position relationship between speakers in the listening environment are defined, not only a mistake in speaker arrangement by the user can be indicated but also parameters of an actual sound source when reproducing a virtual sound image can be accurately set, as a result, the more realistic sound field can be generated.

Figure 18:
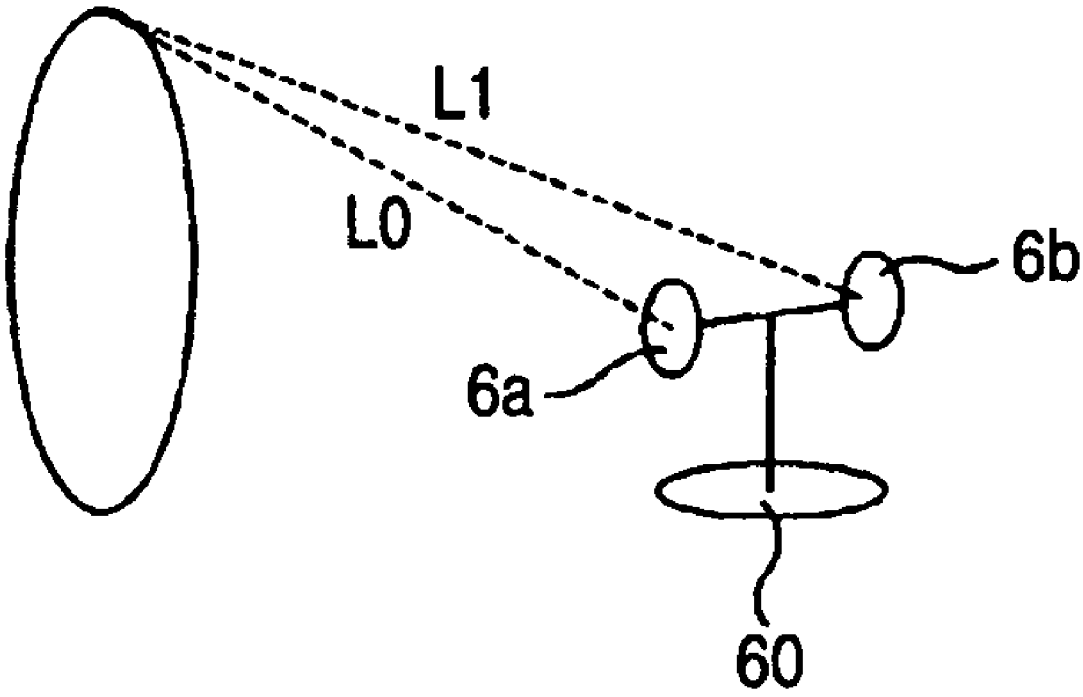
FIG. 18 is a schematic view explaining candidates for position coordinates of the second speaker calculated from audio signals collected by the microphone set 60 in a three-dimensional space.

In the above two examples, respective speakers are supposed to be arranged on the same plane, however, when they are arranged in a three-dimensional space, position coordinates of speakers can be specified by similar methods. In the three-dimensional space, coordinates corresponding to distances L0, L1 between the microphones 6*a*, 6*b* to the specific speaker are distributed on a circumference of a base of a cone whose apex is the microphone 6*a* or 6*b* and whose hypotenuses are the distance L0, L1, as shown in FIG. 18. The center of the cone base is on the extension of the axis connecting the microphones 6*a* and 6*b*.

Figure 19:
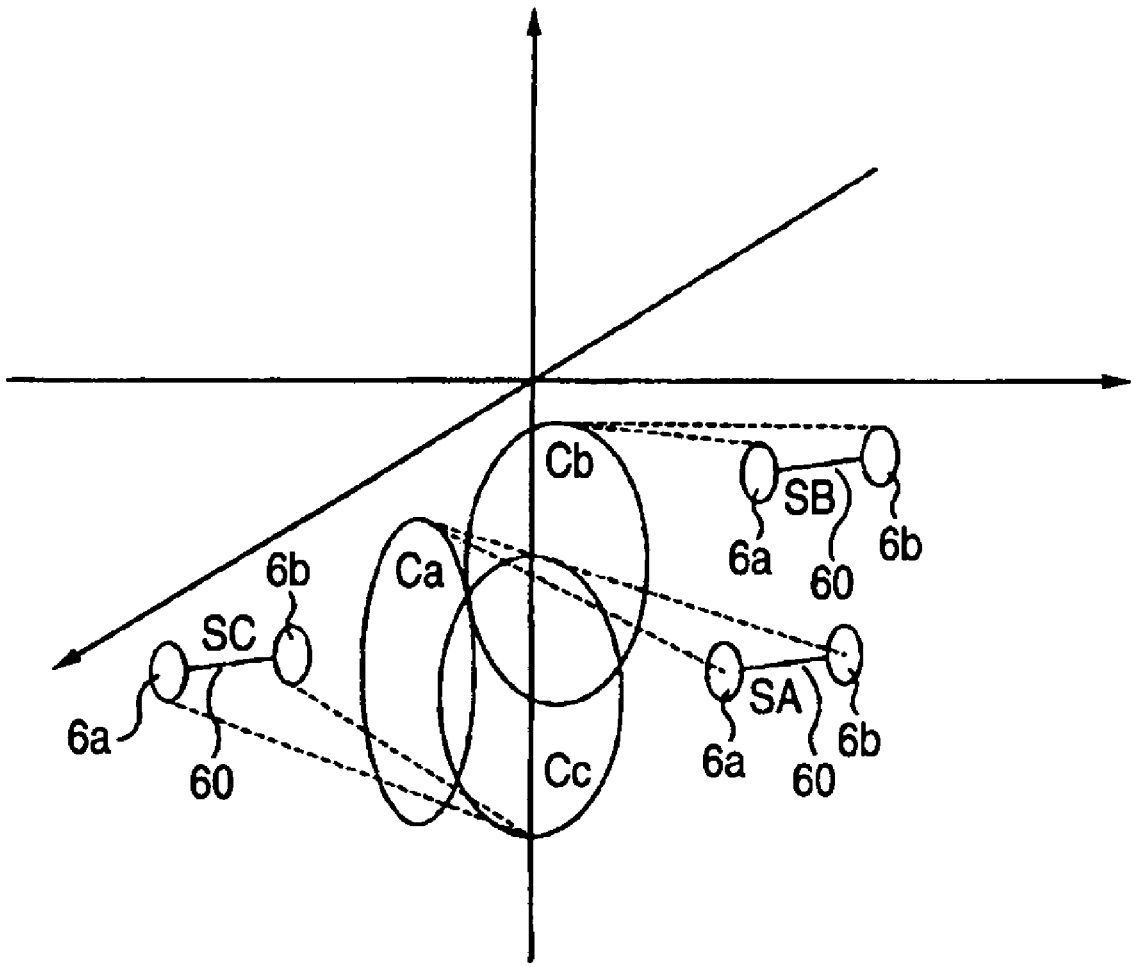
FIG. 19 is a schematic view explaining candidates for position coordinates of the second speaker calculated from audio signals collected by moving the microphone set 60 to an arbitrary position in the three-dimensional space.

Candidates for position coordinates of the speaker will be circular, however, the above acoustic distance measurement is continued by setting the microphone set 60 at random positions in the listening environment, a three-dimensional position of each speaker can be estimated according to intersecting points of candidate circles. In FIG. 19, a state in which candidate circles overlap with each other is shown. A circle "Ca" indicates candidates for position coordinates of the speaker at a measuring position SA of the microphone set 60, a circle "Cb" indicates candidates for position coordinates of the speaker in a measuring position SB of the microphone set 60 and a circle "Cc" indicates candidates for position coordinates of the speaker in a measuring position SC of the microphone set 60. The nearest position coordinates are selected from the candidates as the position coordinates of the speaker.

As described above, position coordinates of the speaker are calculated in each position of the microphone set 60 in the listening environment and by comparing the coordinates, respective speaker positions in the speaker system supporting the multichannel system can be decided. In the multichannel audio system such as the audio system 1 shown in the embodiment, the time alignment adjustment in the listening environment is important. When respective speaker position coordinates are defined in the listening environment, the time alignment adjustment can be performed accurately. In time alignment correction, sound field generating parameters are corrected according to a distance between a certain point and each speaker in the listening environment, and it is difficult in principle to adjust the time alignment so as to satisfy all parameters at plural points. Therefore, one point in positions where the user made measurements is made to be a time alignment adjustment position. It is preferable that this point will be a listening position where the user uses most frequently in the listening environment.

Hereinafter, an example of methods for deciding the optimum position for the time alignment adjustment in the listening environment will be explained. Positional relationship including distances between the microphone set 60 and respective speakers and coordinates thereof is supposed to be fully captured by the acoustic distance measurement by the impulse response and the like.

In the audio set 1, it is natural that the user usually listens at a position near the center of the interior of a space surrounded by respective speakers 51, 52, 53, 54 and 55 which support the multichannels. Accordingly, the microphone set 60 is set in the interior of the space surrounded by speakers, variation of distances from respective speakers to the microphone 60 are calculated as variances or standard deviations, and a position where variation of distances become smallest is decided as a preferable position for the time alignment adjustment position, and time alignment from each speaker is adjusted with respect to the decided preferable position.

Figure 20:
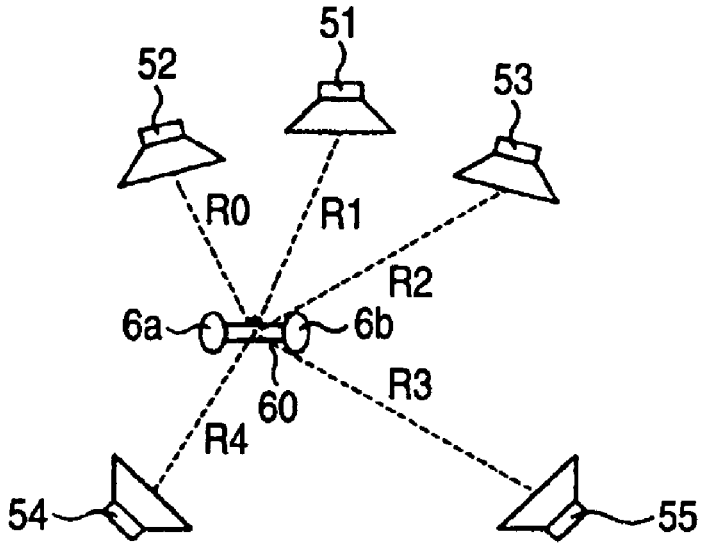
FIG. 20 is a schematic view explaining distances and positional relationship between microphones and speakers as sound sources.
Figure 21:
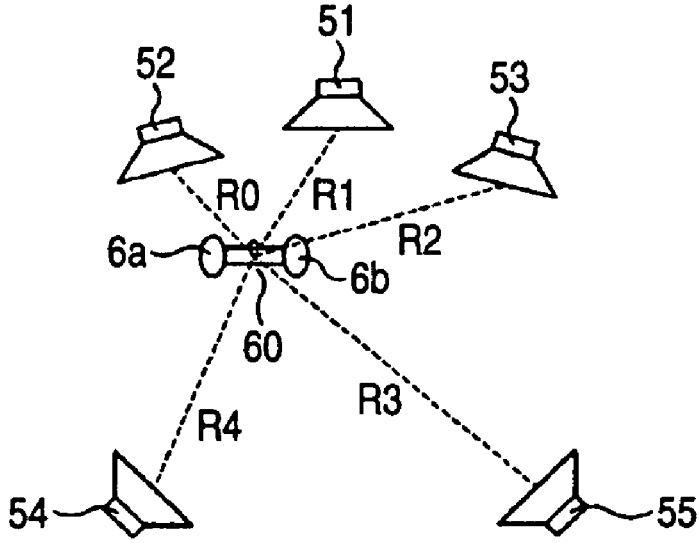
FIG. 21 is a schematic view explaining distances and positional relationship between microphones and speakers as sound sources.

Processing of searching a position of time alignment adjustment position while the position of the microphone set 60 is changed suitably is shown in FIG. 20 and FIG. 21. In FIG. 20 and FIG. 21, a distance between the speaker 52 and the microphone set 60 is "R0", a distance between the speaker 51 to the microphone set 60 is "R1", a distance between the speaker 53 to the microphone 60 is "R2", a distance between the speaker 55 to the microphone 60 is "R3" and a distance between the speaker 54 to the microphone 60 is "R4".

For example, when comparing FIG. 20 with FIG. 21, variation of distances with respect to respective speakers is smaller in the setting position of FIG. 20, which is a suitable for setting the time alignment. Namely, the positions are at almost equal distance from every speaker. The control unit 7 in the audio set 1 controls the measuring unit 331 and makes measurement of the distance between every speaker and that position, then, calculates variation of distances. The control unit 7 advises the user whether the present position (namely, the measurement position) of the microphone set 60 is optimum or not. It is also preferable that the distance variation is digitalized or encoded to be clearly shown to the user.

Figure 22:
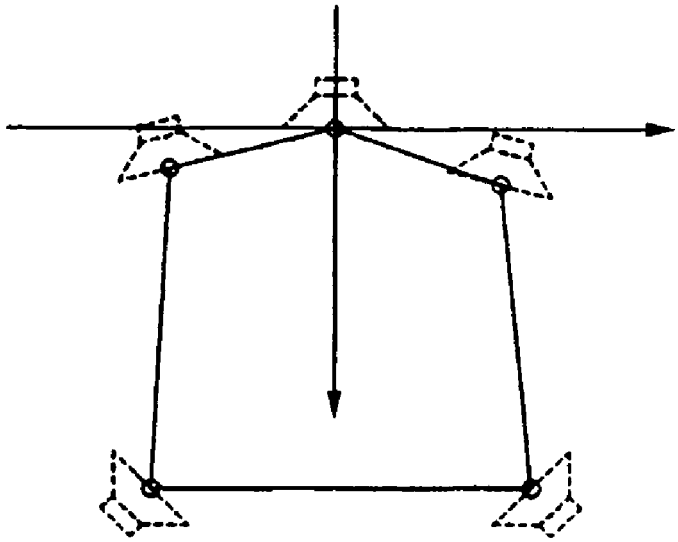
FIG. 22 is a schematic view explaining distances and positional relationship between microphones and speakers as sound sources.

As another example for deciding the optimum position for the time alignment, there is a method of deciding a standard position for the time alignment as a center of a polygon, when the speaker arrangement in the audio set 1 is the polygon, as relative positional relationship of speakers has already been known. For example, when it is known that a 5-channel speaker system exists as shown in FIG. 22 by the processing for specifying position coordinates of speakers of the audio set 1, the gravity center of the polygon formed by connecting the speaker positions in the prescribed order is calculated, which will be the standard position of the time alignment.

Figure 23:
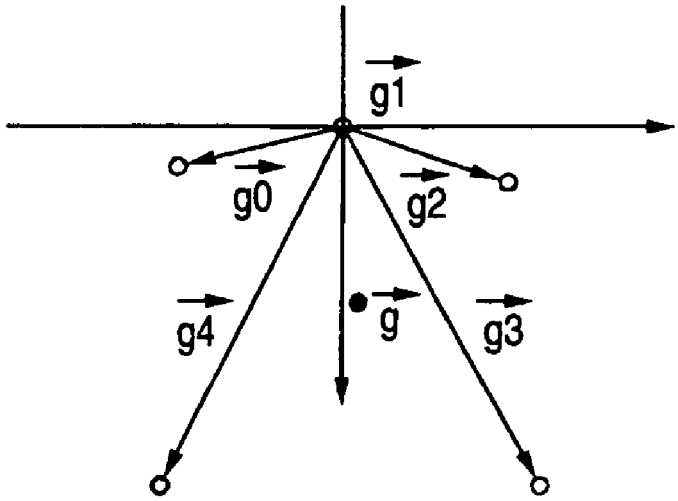
FIG. 23 is a schematic view explaining distances and positional relationship between microphones and speakers as sound sources.

There are the geometrical centroid and the physical centroid in the centroid in the polygon. In the embodiment, a preferable position is calculated according to the physical centroid "g" as an example. In FIG. 23, a method for calculating the centroid in a polygon which is formed by connecting the specified speaker position coordinates is shown. Calculation is performed according to the case of calculating the physical centroid g, taking inertial mass "mi" as weighting for each channel in multichannels, and taking a position vector "gi" of the mass point as the position vector of the speaker by using the following formula (1).

$$\text{Physical } centroid\ \vec{g} = \frac{\sum m_i \vec{g}_i}{\sum m_i} \tag{1}$$

The sound field synthesis parameters are set by taking the physical centroid calculated as the above as the suitable position for the time alignment, thereby generating a realistic listening environment for the user. The position for the time alignment adjustment can be decided by the methods including the above two examples, however, the time alignment can be adjusted at a position where the user listens. It is also preferable that the position for time alignment adjustment is inputted by the user directly.

According to the audio set 1 on which the sound field measuring apparatus according to an embodiment of the invention is loaded, the optimum position for adjusting time alignment can be specified. The sound field created by audio signals generated based on the specified speaker positions and the time alignment adjustment position, which are emitted from respective speakers provides more realistic sensation at the appropriate listing position, and the reality is improved.

As described above, the audio set 1 can specify speaker positions which are generally not specified by two microphones by repeating measurements with the microphone set 60 being set at plural different positions, and further, the audio set 1 can correct the audio signals more accurately when the optimum signal processing is performed to audio signals of respective channels according to the speaker positions calculated at the speaker position calculating unit 333. The sound field created in the listening environment by audio signals corrected as the above provides more realistic sensation at the appropriate listing position, and the reality is improved for the user.

As the audio set to which the above sound field measuring apparatus is applied, an AV (Audio video) system which can reproduce not only audio but also video is also preferable. In this case, the audio set includes a LCD device (LCD: Liquid Crystal Display) and the like as a display means for displaying video data, as well as a configuration capable of reproducing video content data.

Figure 3:
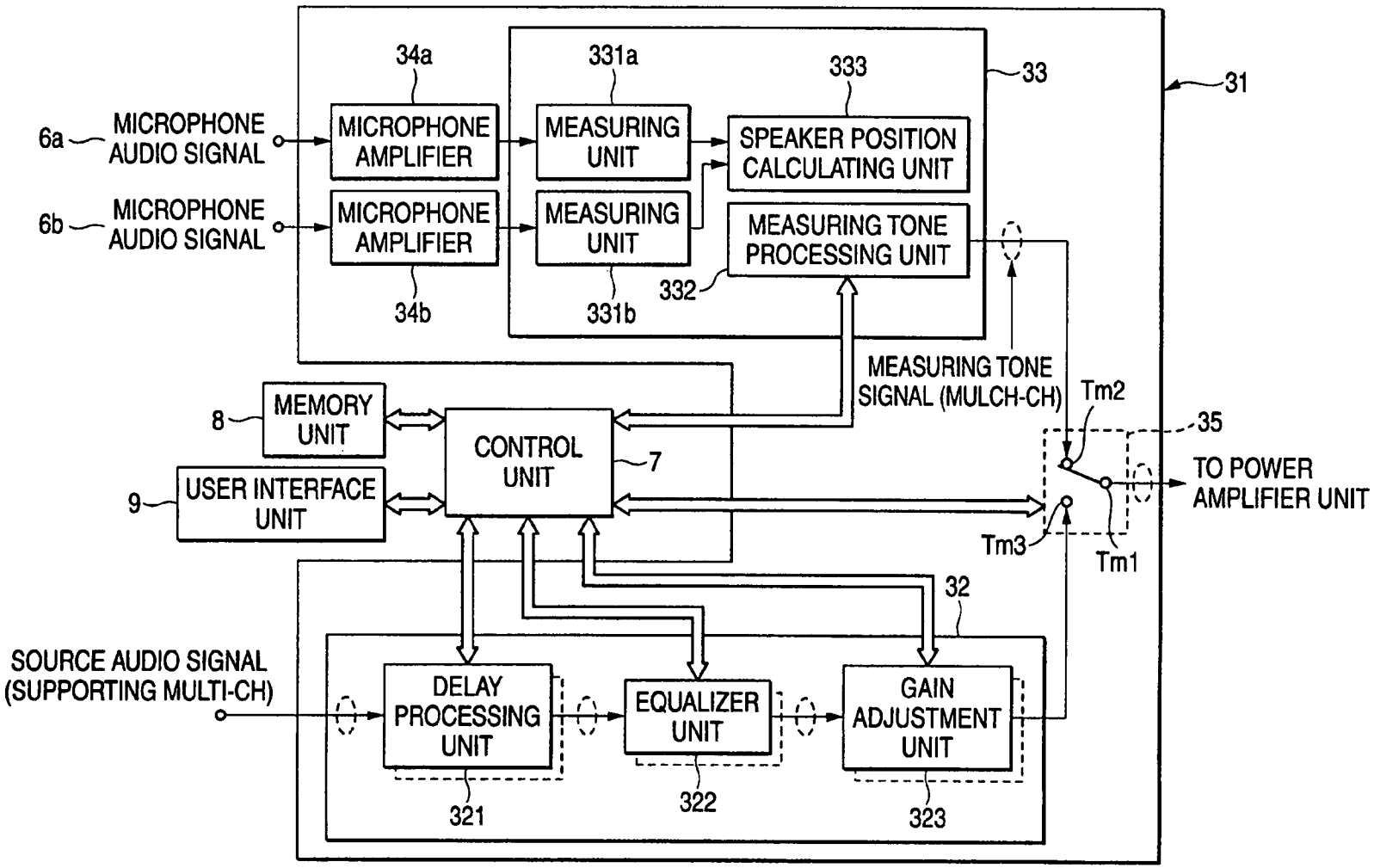
FIG. 3 is a structural diagram for explaining a sound field correction/measuring function unit in the audio set.

Furthermore, in the above description, the example in which correction information is propagation delay time from the speaker to the listening position, and the example in which the sound field correction is the adjustment of time alignment (adjustment of signal delay time) have been explained, however, as sound field correction with respect to the target correction position based on the embodiment of the invention may be sound correction in the gain adjustment unit in FIG. 3 and the like other than the time alignment. That is, sound field correction in which attenuation in a sound pressure level is compensated according to distances from respective speakers and the listening point may be performed. It is possible to use these plural correction methods in combination.

According to an embodiment of the invention, when the actual playback sound field in the listening environment is measured by using two microphones, speaker positions in the listening environment can be accurately specified.

It should be understood by those skilled in the art that various modifications, combinations, sub-combinations and alterations may occur depending on design requirements and other factors insofar as they are within the scope of the appended claims or the equivalents thereof.

What is claimed is:

1. A sound field measuring apparatus, comprising:

a microphone set having a first and a second microphone attached together and arranged at a prescribed interval, which collect audio signals outputted from a first and a second speaker;

a measuring unit configured to measure distances between the first and second speakers and the first and second microphones based on squared waveforms of the audio signals collected by the first and second microphones; and a position calculating unit for calculating coordinate positions of the first and second microphones and candidate coordinate positions and an actual coordinate position of the second speaker when the first speaker is taken as a reference coordinate position based on respective measured distances, wherein the microphone set is separated from the speakers and is configured to be moved from a first measurement position to a second measurement position with respect to the first speaker to enable calculating the coordinate positions of the first and second microphones at the second measurement position and calculating the candidate coordinate positions and the actual coordinate position of the second speaker.

2. The sound field measuring apparatus according to claim 1, wherein the measuring unit comprises:

a computing unit configured to calculate an impulse response for an impulse signal between a speaker of the first and second speakers and a microphone of the first and second microphones from the collected audio signals;

a detecting unit configured to calculate delay time from an output start time of the impulse signal to a rising part of the impulse response; and a calculating unit configured to calculate a distance between the speaker and the microphone from the calculated delay time.

3. The sound field measuring apparatus according to claim 1, wherein the position calculating unit is configured to identify a coordinate position of the first speaker as being positioned in a positive direction area with respect to the microphone set based on a distance between the microphone set and the first speaker measured at the measuring unit with respect to the first speaker, and calculate candidates for a coordinate position of the second speaker with respect to the microphone set, taking the first speaker as the reference coordinate position.

4. The sound field measuring apparatus according to claim 3, wherein the position calculating unit is configured to compare candidates for the coordinate position of the second speaker calculated from audio signals outputted from the second speaker and collected by the microphone set installed at the first measurement position to candidates for the coordinate position of the second speaker calculated from audio signals outputted from the second speaker and collected by the microphone set installed at the second measurement position to specify the actual coordinate position of the second speaker.

5. The sound field measuring apparatus according to claim 4, wherein the first and second microphones installed at the second measurement position are not on a line connecting the first and second microphones installed at the first measurement position.

6. The sound field measuring apparatus according to claim 4, wherein, in the first measurement position and the second measurement position, a distance between the first speaker and the first microphone, and a distance between the first speaker and the second microphone are almost equivalent.

7. A sound field measuring method, comprising the steps of:

collecting and squaring first audio signals outputted from a first and a second speaker by a microphone set having a first and a second microphone attached together and arranged at a prescribed interval;

measuring respective distances between the first and second speakers and the first and second microphones based upon the first audio signals;

moving the microphone set without moving any speaker from a first position to a second position with respect to the first speaker and collecting and squaring second audio signals outputted from the first and second speakers by the microphone set;

calculating, by a calculation unit, coordinate positions of the first and second microphones and candidate coordinate positions of the second speaker when the first speaker is taken as a reference coordinate position based on the respective measured distances; and calculating, by the calculation unit, an actual coordinate position of the second speaker after moving the microphone set from the first position to the second position based upon the second audio signals.

8. The sound field measuring method according to claim 7, wherein, in the step of calculating the coordinate position, a coordinate position of the first speaker is calculated as being located in a positive direction area with respect to the microphone set based on a distance between the microphone set and the first speaker measured at the measuring step with respect to the first speaker, and candidates for a coordinate position of the second speaker with respect to the microphone set are calculated, taking the first speaker as the reference coordinate position.

9. A method for determining locations of speakers of a sound field system, the method comprising:

receiving, at a first location by each microphone of a pair of microphones that are attached together and separate from the speakers, a first measurement tone signal from a first speaker;

setting, by a calculation unit, a coordinate position of the first speaker to be a reference position;

calculating, by the calculation unit and based upon the first measurement tone signal, a first coordinate location of the pair of microphones with respect to the reference position;

receiving, at the first location by the pair of microphones, a second measurement tone signal from a second speaker;

calculating, by the calculation unit and based upon the second measurement tone signal, two candidate coordinate positions of the second speaker with respect to the reference position;

moving the pair of microphones to a second location or rotating the pair of microphones;

receiving, by the pair of microphones, a third measurement tone signal from the second speaker; and determining, by the calculation unit and based upon the third measurement tone signal, which of the two candidate coordinate positions is an actual position of the second speaker.

10. The method of claim 9, wherein the pair of microphones consists of two microphones.

11. The method of claim 9, wherein the reference position is taken to be an origin (0,0).

12. The method of claim 9, wherein the acts of calculating positions further comprise squaring audio waveforms received by the microphones and calculating a delay between an emission time from a speaker of a measurement tone signal and a time at which a rising edge of the squared audio waveforms crosses a set threshold value.

13. The method of claim 9, wherein the act of calculating the first coordinate location of the pair of microphones sets the coordinate location of the pair of microphones to be in a selected direction.

14. The method of claim 13, wherein the selected direction is positive.

* * * * *